US007061448B2

(12) United States Patent
Kuroda et al.

(10) Patent No.: US 7,061,448 B2
(45) Date of Patent: Jun. 13, 2006

(54) RADIO WAVE LENS ANTENNA APPARATUS

(75) Inventors: Masatoshi Kuroda, Osaka (JP); Tetsuo Kishimoto, Osaka (JP); Katsuyuki Imai, Osaka (JP); Yoshizo Shibano, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 69 days.

(21) Appl. No.: 10/490,942

(22) PCT Filed: Sep. 9, 2002

(86) PCT No.: PCT/JP02/09179

§ 371 (c)(1),
(2), (4) Date: Aug. 17, 2004

(87) PCT Pub. No.: WO03/030303

PCT Pub. Date: Apr. 10, 2003

(65) Prior Publication Data

US 2004/0263418 A1 Dec. 30, 2004

Related U.S. Application Data

(60) Provisional application No. PCT/JP02/09179, filed on Sep. 9, 2002.

(30) Foreign Application Priority Data

Sep. 28, 2001 (JP) ..... 2001-299843
Sep. 28, 2001 (JP) ..... 2001-300240
Sep. 28, 2001 (JP) ..... 2001-301144

(51) Int. Cl.
*H01Q 15/08* (2006.01)
*H01Q 19/06* (2006.01)

(52) U.S. Cl. ..... 343/911 L; 343/753; 343/754

(58) Field of Classification Search ..... 343/911 L, 343/753, 754, 909

See application file for complete search history.

(56) References Cited

U.S. PATENT DOCUMENTS 4,287,519 A * 9/1981 Doi ..... 343/725

(Continued)

FOREIGN PATENT DOCUMENTS

EP 1074064 A 2/2001

(Continued)

*Primary Examiner*—Hoang V. Nguyen
(74) *Attorney, Agent, or Firm*—McDermott Will & Emery LLP

(57) ABSTRACT

A small, lightweight radio wave lens antenna device is proposed in which freedom of selection of the installation place is high, which can be compactly installed e.g. on a wall surface, and in which restriction of installation space is relaxed. A hemispherical Luneberg lens 2 is mounted on a reflecting plate 1, antenna elements 4 are supported by a retainer 3, they are integrally combined, and a mounting portion 5 is provided for mounting the reflecting plate 1 to a installation portion such as a wall surface with the reflecting plate 1 substantially vertical. The reflecting plate 1 may have such a shape that an area other than the area for reflecting radio waves from directions in a predetermined range is removed, preferably in the shape of a fan. The hemispherical Luneberg lens 2 is mounted on the reflecting plate 1, offset toward the small arcuate edge 1*b* of the fan. Further, a support arm 9 straddling the lens 2 is provided in the antenna device having a hemispherical Luneberg lens 2 provided on the reflecting plate 1, antenna elements 4 are mounted on an arcuate element retaining portion 9*a* of the support arm 9 along the spherical surface of the lens 2 with an angle adjustor 15 for adjusting the elevation at intervals corresponding to the distances between geostationary satellites by means of mounting means 11. Thereafter, the support arm 9 is pivoted to a predetermined angular position so that the antenna elements can be comprehensively positioned.

22 Claims, 16 Drawing Sheets

U.S. PATENT DOCUMENTS 5,225,668 A * 7/1993 Hilliard et al. ..... 250/206.2

6,266,029 B1 * 7/2001 Lee et al. ..... 343/911 L 6,329,956 B1 12/2001 Tateishi 6,333,718 B1 * 12/2001 Poncel et al. ..... 343/753

6,356,247 B1 * 3/2002 Hirtzlin et al. ..... 343/911 L

FOREIGN PATENT DOCUMENTS

EP 1074065 A 2/2001

JP 2001-044746 A 2/2001

JP 2002513230 A 5/2002

JP 2002513321 A 5/2002

JP 2002-232230 A 8/2002

WO WO 99/56347 A 11/1999

WO WO 99/56348 A 11/1999

* cited by examiner (a)

(b)

(a)

(b)

(a)

(b)

(a)

(b)

(a)

(b)

(a)

(b)

RADIO WAVE LENS ANTENNA APPARATUS

This application is a 371 of PCT/JP02/09179 dated Sep. 9, 2002.

TECHNICAL FIELD TO WHICH THE PRESENT INVENTION BELONGS

This invention relates to a radio wave lens antenna device used for satellite communication and communication between antennas. More specifically, it relates to radio wave lens antenna devices using a Luneberg lens and used e.g. to receive radio waves from a plurality of geostationary satellites, or transmit radio waves toward the geostationary satellites, and a pointing map (that is, drawing used as an index for positioning) that makes it accurate and easy to position antenna elements of this device for transmitting and receiving radio waves.

PRIOR ART

A Luneberg lens, which is known as one of radio wave lenses, is made of a dielectric materials basically in the form of a sphere. The relative dielectric constant $\in r$ of each part thereof substantially follows the formula (1).

$$\in r = 2-(r/a)^2 \qquad \text{formula (1)}$$

wherein a: radius of the sphere r: distance from the center of the sphere

An antenna device using such a Luneberg lens can capture radio waves from any direction and transmit them in any desired direction with the focal point of radio waves set at any desired position.

Using this advantage, an antenna device which can track an orbiting satellite has been invented. Such a satellite-tracking type antenna device includes a hemispherical Luneberg lens mounted on the center of a horizontally arranged (parallel to the ground) circular reflecting plate, an arch type support arm straddling the spherical surface of the lens, a mechanism for pivoting the support arm with horizontal pivots at both ends of the arm as fulcrums, and a mechanism for pivoting the lens and the reflecting plate, a mechanism for pivoting the lens and the reflecting plate including the arm pivoting mechanism with a vertical central axis as a fulcrum, and an antenna element (primary radiator) having a longitudinal position adjusting mechanism and mounted on the support arm.

This antenna device can move the primary radiator to the focal point of radio waves from a satellite which fluctuates with the movement of the satellite, using the arm pivoting mechanism, pivoting mechanism and longitudinal position adjusting mechanism for the arm. Thus compactness and lightness in weight are achieved compared with a satellite tracking type parabolic antenna.

An antenna device formed by combining a hemispherical Luneberg lens with a reflecting plate can cope with radio waves from any direction by moving the antenna element to any desired position on the spherical surface of the lens. In order to cope with radio waves from all of the 360° directions, it is essential that the reflecting surface be horizontal. Thus, it has been considered a matter of course to horizontally place the reflecting plate.

Among such Luneberg lens antenna devices, there is one in which a hemispherical lens is combined with a reflecting plate so that it will have functions equivalent to a spherical lens. FIG. 24 schematically shows such a device. It shows a reflecting plate 1, a hemispherical Luneberg lens 2, and an antenna element 4.

With this type of antenna device, in order to obtain stable trasmission/receiving performance, it is required that the distance from the lens center to the outer edge of the reflecting plate 1 (that is, radius R of the reflecting plate) be greater than the radius a of the lens 2. The radius R of the reflecting plate is given by formula $R=a/\cos\theta$, wherein $\theta$ is the incident angle of radio waves. The radius R may exceed twice the radius a depending upon the incident angle of radio waves.

Problems the Invention Intends to Solve

With a hemispherical Luneberg lens antenna device using a reflecting plate, in order to achieve stable transmission/receiving performance, it is required that the distance from the lens center to the outer edge of the reflecting plate 1 (radius R of the reflecting plate) be greater than the radius a of the lens 2. The radius R may exceed twice the radius a. Thus, this reflecting plate is the largest part among the parts of an antenna device.

If such a large reflecting plate is installed horizontally based on the conventional concept, a large space is needed and the installation space is limited. Also, due to limitation in space, a situation in which an antenna device cannot be installed may occur.

The present inventors considered using such a hemispherical Luneberg lens antenna device as a TV antenna for satellite broadcasting at a general household. But at a general household, it tends to be particularly subjected to restriction about the installation location.

Also, for outdoor horizontal installation, there are problems of snowfalls and raindrops remaining on the reflecting plate. Thus measures against them are also required. A first object of this invention is to solve these problems.

A Luneberg lens antenna device has an advantage that it can cope with radio waves from any direction by moving the antenna element to any desired position on the spherical surface of the lens. Thus, in this type of conventional device, it has been considered to make use of this advantage by forming the reflecting plate in the shape of a disk concentric with the lens and placing it horizontally (parallel to the ground).

But since in this structure the reflecting plate protrudes beyond the entire periphery of the lens, such problems as increased size, weight, cost and installation space of the device, and difficulty in handling occurs.

Heretofore, solving these problems has not been considered at all.

Therefore, a second object of this invention is to achieve compactness, lightness in weight and reduced cost for a Luneberg lens antenna device using a reflecting plate without sacrificing electrical performance required for a radio wave lens antenna device.

E.g. in Japan, there exist a plurality of geostationary satellites for satellite broadcasting. To receive radio waves from such geostationary satellites, parabolic antennas are used. But parabolic antennas or the above-described satellite-chasing type lens antenna device can cope with only one satellite or satellites at the same one point.

Also, a parabolic antenna is narrow in the area in which it can capture radio waves. Thus, for satellites outside the capturable region, the number of antennas used has to be increased.

A third object of this invention is to provide a radio wave lens antenna device which can independently transmit or receive radio waves to and from a plurality of geostationary satellites.

Such a radio wave lens antenna device has a plurality of antenna elements corresponding to the number of satellites. But it is not easy to position a plurality of antenna elements on the respective focal points of radio waves from target satellites. Thus, a solution to this problem is also provided.

With a conventional parabolic antenna, in aligning the radio wave transmitting and receiving direction to the direction where there exists a satellite, a spherical coordinate system at the antenna installation point is considered, and the direction is determined using two variables that cross perpendicular to each other, i.e. the azimuth $\phi$ and elevation $\theta$ (see FIG. 25) at the antenna installation point.

Since the azimuth and elevation vary widely according to the region (point to be exact) where the antenna is installed, e.g. for parabolic antennas for BS and CS broadcasting, rough adjustment is made using a special map on which are drawn equal azimuth lines and equal elevation lines as a reference, and thereafter, while seeing the receiving sensitivity numerical value displayed on a TV screen, fine adjustment is made to search an optimum direction.

But the directional adjustment by this method is difficult and time-consuming for a person who is not accustomed to such adjustment. With an antenna device using a Luneberg lens, the position of not the antenna itself but the antenna element is adjusted. But since the type which allows independent transmissions and receptions for a plurality of geostationary satellites (multi-beam accommodated type) has a plurality of antenna elements, it is necessary to repeat troublesome work and a long time is needed for adjustment.

In Japan, currently, there exist a plurality of geostationary satellites in the range of 110°–162° east longitude. Among them, only three at the position of long. 110° E. can be handled with a single antenna element. Other satellites are slightly offset from another. Thus, in order to cope with all the satellites, under the present circumstances, at least ten antenna elements are needed. Even to cope with half of the satellites, 4–6 antenna elements are needed. Thus, adjustment is extremely troublesome.

A fourth object of this invention is to make it possible to reliably and easily position a plurality of antenna elements relative to the respective satellites.

Means to Solve the Problems

In order to solve the first object, according to this invention, there is provided a radio wave lens antenna device comprising a hemispherical Luneberg lens made of a dielectric material, a reflecting plate having a larger size than the diameter of the lens at a half-cut surface of the sphere of the lens, an antenna element provided at the focal point of the lens, a retainer for retaining the antenna element, and a mounting portion for mounting the antenna device on an installation portion, the reflecting plate being mounted on the installation portion so as to be substantially vertical relative to the ground.

In this antenna device, the mounting portion may e provided on the reflecting plate, and directly mounted to a wall surface or side surface of a building.

The space can also be used effectively in an arrangement wherein the reflecting plate is mounted on the installation portion so as to be inclined relative to the ground along an inclined surface of the installation portion.

Since this antenna device can be installed with the reflecting plate substantially vertical, the installation space can be small.

Also, the antenna device can be installed on wall surfaces, fences of verandas, rooftops, poles erected on verandas, and horizontal poles mounted to walls. Geostationary satellites for satellite broadcasting are located south-west e.g. in Japan. In this case, a horizontally arranged antenna can be installed only at a place open in the south-west direction. But by arranging it vertically, since buildings have walls facing west or south-west, such a surface can be used as an installation portion, restriction in space is relaxed, and freedom of selection of the installation point increases. It is also possible to mount it directly on a side of a veranda fence to which a parabolic antenna is often installed, or on a pole for a TV antenna. By mounting it at such a location, the antenna will not be an obstacle.

Further, by erecting the reflecting plate substantially vertically, raindrops will spontaneously drop and snow will be less likely to stick.

Besides, since the lens is hemispherical, the strength is high and it is less likely be affected by wind pressure. Further, it is possible to increase the support area by using the reflecting plate. Thus, by mounting it to a stable wall or fence, good wind resistance can be achieved. Since parabolic antennas used in ordinary households are supported at one point, they are not sufficient in stability and wind resistance. This invention solves this problem, too.

In order to solve the second object, there is provided a radio wave lens antenna device comprising a hemispherical Luneberg lens made of a dielectric material, a reflecting plate having a larger size than the diameter of the lens at a half-cut surface of the sphere of the lens, and an antenna element provided at the focal point portion of the lens, and a retainer for retaining the antenna element, wherein the reflecting plate is formed into a noncircular shape by removing an area other than a portion which reflects radio waves from directions in a predetermined range, and wherein the Luneberg lens is mounted on the reflecting plate offset to a direction opposite to the direction in and from which the lens transmits and receives radio waves.

Preferably, the reflecting plate has a fan-like shape defined by a large arcuate edge concentric with the center of the lens and having a larger diameter than the lens, a small arcuate edge arranged at a position near the outer periphery of the lens opposite the large arcuate edge, and side edges connecting the ends of the large arcuate edge with the ends of the small arcuate edge, or a shape enclosing such a fan.

Ideally, based on such a fan shape, the large arcuate edge of the reflecting plate is cut out so that any portion where the radio wave incident angle is the smaller, the shorter the distance (R is calculated by the formula $R=a/\cos\theta$) from the lens center to the edge. An ideal shape is obtained by projecting the hemispherical lens on the reflecting surface at the same angle as the wave incident angles from communicating parties at extreme both ends from the opposite direction to the incident direction of radio waves, and removing both side edges along the contour of the projected half ellipse. In this ideal shape, if the incident angles of radio waves from communicating parties at extreme both ends are different, the reflecting plate will be asymmetrical (which is referred to as a deformed fan shape). For an antenna device used in Japan, if the fan-shaped or deformed fan-shaped reflecting plate has a spread angle of the fan of 130°, it is possible to cope with all the existing geostationary satellites.

The inventors thought of utilizing a Luneberg lens antenna device using a reflecting plate to transmit and receive radio waves between the antenna device and geostationary satellites. To receive radio waves such as BS broadcasting or the like, parabolic antennas are used. But they are exclusively for receiving and further can work for satellites only in specific directions. In contrast, a Luneberg lens antenna device can capture radio waves from a plurality of satellites by providing a plurality of antenna elements on focal points for radio waves from the respective geostationary satellites. Also, by increasing the number of antenna elements, it is possible to carry out bilateral communication (transmission and reception) without any time difference.

In our country (Japan), there exist more than ten geostationary satellites now. These are all in the range of long. 110–162° E. If a circular reflecting plate is used, radio waves are reflected only at its limited area, and no radio waves are reflected at other areas. Noting this fact, in this invention, nonfunctional areas where no radio waves are reflected are removed. Thus, the reflecting plate is noncircular and its size is reduced.

The radio wave transmission and receiving direction varies according to where the antenna is installed. For example, in Yonakuni, the azimuth for a satellite at long. 110° E., is 209.2° and the azimuth for a satellite at long. 162° E. is 117.1° with due north at 0°, the difference therebetween being 92.1°. In Japan, the difference in azimuth between the geostationary satellites at long. 110° E. and 162° E. is especially large in Yonakuni. Thus, if the reflecting plate has a symmetrical fan shape or a deformed fan shape, the spread angle on one side (the side that has a greater spread angle from the center) is 180–171.1=62.9. For a symmetrical shape, twice this angle, i.e. 125.8° is needed. Thus, by setting the spread angle of the fan at about 130°, it is possible to use reflecting plates of the same shape all over Japan.

The size of the reflecting plate (radius R of the large arcuate edge of the fan) has an optimum value for each place of use of the antenna, because the incident angle θ of radio waves for each geostationary satellite varies with the place where the antenna is used. But if it is supposed that the target area is nationwide and the communicating target satellites are 12, $R \geqq a \times 2.19$ (a is the radius of the lens). Thus, if the radius meets this formula, it is possible to use reflecting plates of the same size all over Japan.

Next, in order to solve the third object, there is provided a radio wave lens antenna device comprising a reflecting plate for radio waves, a hemispherical Luneberg lens provided on the reflecting plate with the half-cut surface of the sphere along the reflecting surface, an antenna element for transmitting, receiving or transmitting and receiving radio waves, and a retainer for retaining the antenna elements in a predetermined position, the antenna element being plural so as to correspond to a plurality of communicating parties.

Also, there is provided a radio wave antenna device comprising a reflecting plate for radio waves, a hemispherical Luneberg lens provided on the reflecting plate with the half-cut surface of the sphere along the reflecting surface, an antenna element for transmitting, receiving or transmitting and receiving radio waves, and an arch type support arm that straddles the lens, wherein the antenna element being plural, further comprising means for mounting the antenna elements at intervals corresponding to the distances between geostatic satellites, provided on an arcuate element retaining portion of the support arm extending along the spherical surface of the lens, and an elevation adjusting mechanism for pivoting the support arm to a desired position about an axis passing the center of the lens.

Further, in order to solve the fourth object, there is provided a pointing map for a radio wave lens antenna device having a cover which is put on a hemispherical Luneberg lens, wherein the following equal latitude lines and equal longitude difference lines used as indexes for positioning antenna elements, and a pointing mark showing a reference direction for mounting the cover on the lens are drawn on the surface of the cover, assuming that the latitude of the antenna installation point is θ, and its longitude is ϕ, and the longitude of a geostationary satellite is ϕs and its longitude difference $\Delta\phi=\phi-\phi s$, the equal longitude difference lines are loci on a hemispherical surface obtained by changing θ while keeping Δϕ constant, and the equal latitude lines are loci on a hemispherical surface obtained by changing Δϕ while keeping θ constant.

Also, there is provided a pointing map for a radio wave lens antenna device wherein the following equal latitude lines and equal longitude difference lines used as indexes for positioning antenna elements are drawn on the surface of a hemispherical Luneberg lens or on a film stuck on the surface of said lens, assuming that the latitude of the antenna installation point is θ, and its longitude is ϕ, and the longitude of a geostationary satellite is ϕs and its longitude difference $\Delta\phi=\phi-\phi s$, the equal longitude difference lines are loci on a hemispherical surface obtained by changing θ while keeping Δϕ constant, and the equal latitude lines are loci on a hemispherical surface obtained by changing Δϕ while keeping θ constant.

Also, there is provided a radio wave lens antenna device wherein the above radio wave lens antenna device is combined with the above pointing map.

If this antenna device is used with the reflecting plate arranged horizontally, it can cope with only radio waves from above the reflecting plate. But for a plurality of geostationary satellites that exists on a surface including the equator, a single device having as many antenna elements as the satellites to be captured can independently receive or transmit radio waves for the respective geostationary satellites. This is a big advantage of the antenna device according to this invention.

Also, with this antenna device, by means of element mounting means, the antenna elements are first mounted on the element retaining portion of the support arm at intervals corresponding to the distances between the geostationary satellites.

Next, the elevation is determined by use of a table or map prepared beforehand based on the latitude and longitude of the antenna installation point, and the support arm is pivoted to the elevation thus determined and locked in this position.

Thereafter, the antenna device is directed in the designated direction and installed. Thus, the positioning of the antenna elements can be made comprehensively, with the respective elements set at corresponding positions and intervals corresponding to the satellites.

Thus, the antenna elements are positioned at such positions that they can capture substantially all of the target satellites.

Since the focal points from the target satellites are substantially along the arcuate element retaining portion of the support arm, the antenna elements are aligned substantially near the focal points of radio waves. Here, the term "substantially" was used because the focal points are completely along the arcuate element retaining portion only if the observation point is on the equator. At the latitude off the equator, a shift develops between the focal points and the arc of the retaining portion. Such a shift of the elements from the focal points due to change in the latitude is not very large and ignorable. For example, if a lens antenna having a diameter of about 40 cm (commercial parabolic antennas for BS and CS broadcasting have a diameter of about 45 cm) is used, the half value width of radio wave beams is about four degrees, and a shift of about one degree is within a range bearable to use. Of course, such a shift is preferably zero. By providing a fine adjustment mechanism for azimuth and elevation, it is possible to correct such a shift.

Also, while the azimuth and elevation of a satellite as viewed from the antenna installation point varies with the antenna installation point, with a fine adjustment mechanism for azimuth and rotation angle for adjusting polarized waves, it is possible to cope with change in angle due to change in the installation point.

By preparing arms for respective regions having the elements mounted at intervals corresponding to the distances between satellites in the respective regions, it is also possible to reduce the error.

Thus, with the antenna device of this invention, positioning of the antenna elements can be comprehensively carried out so as to correspond to a plurality of satellites. Thus adjustment can be made easily, reliably and speedily.

If the distances between the elements are narrow, the problem of interference between the elements will arise. With a device having a plurality of support arms, by mounting the elements separately on the support arms, it is possible to widen the distances between the elements on the same arms, and to relax the restriction for mounting due to mutual interference.

E.g. in Japan, satellites exist in a limited range of long. 110–162 degrees E. Thus, support arms can be used which have both ends straightened for compactness, thereby shortening the distance between both ends, or both ends bent as viewed from a side so that the element retaining portion can be easily arranged along the positioning points of the antenna elements. In order to distinguish these arms from hemispherical arms, they are called deformed arms.

Next, by providing the pointing map, it is possible to confirm the installation points of the antenna elements on a map. It is also possible to affix marks on the confirmed positions. Thus, by positioning the elements at the marked points, they can be reliably positioned. Thus adjustment is easy even for an antenna device in which the antenna elements have to be separately positioned.

EMBODIMENTS OF THE INVENTION

Hereinbelow, the first embodiment of the radio wave lens antenna device of this invention will be described with reference to FIGS. 1–6.

Figure 1:
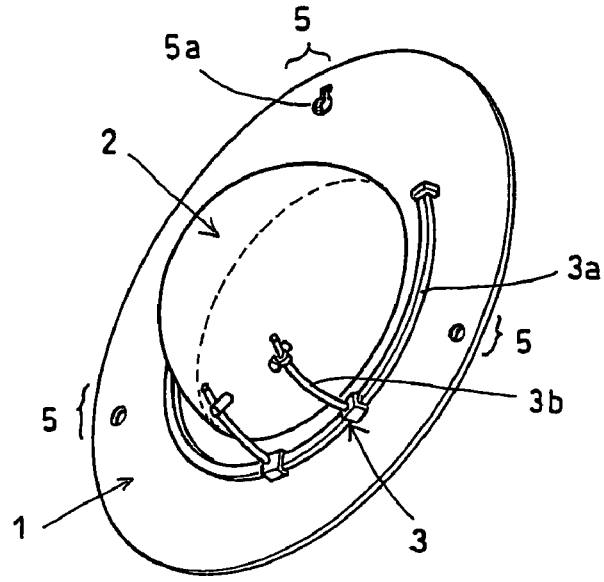
FIG. 1 is a perspective view showing an embodiment of the antenna device of this invention.
Figure 2:
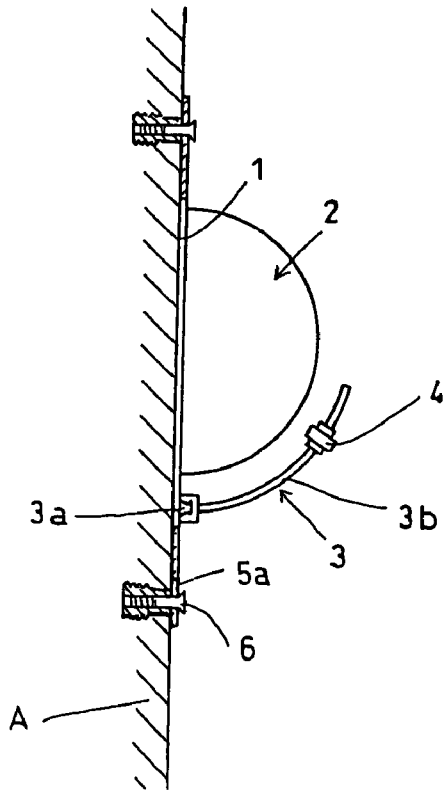
FIG. 2 is a partially cutaway side view showing an example of mounting the antenna device.

As shown in FIGS. 1 and 2, this antenna device has a hemispherical Luneberg lens 2 fixed to a reflecting plate 1, antenna elements (primary radiators) 4 retained by retainers 3 provided on the reflecting plate 1 so as to be located near the spherical surface of the lens 2, and mounting portions 5 for mounting the reflecting plate 1 to a wall surface.

The reflecting plate 1 is made e.g. of a composite board made by laminating a metallic or plastic plate that has a good radio wave reflectance and a metallic sheet for reflecting radio waves. Its shape is not limited to a circle if it can reflect radio waves from a communicating partner.

The Luneberg lens 2 is made by integrally stacking hemispherical shells made of a dielectric material and having their dielectric constants and diameters changing gradually on a center semisphere made of a dielectric material so as to form a multi-layer (e.g. eight-layer) structure, so that the dielectric constants at various parts will be approximate to values calculated from the formula (1).

The cut surface (circular flat surface) of the sphere of hemispherical Luneberg lens 2 cut in half is fixed to the reflecting surface of the reflecting plate 1 e.g. by bonding. The lens 2 may be mounted on the center of the reflecting plate 1. But by offsetting it to the side opposite to the direction from which radio waves are coming, it is not necessary to use an unnecessarily large reflecting plate 1. The hemispherical lens as used herein encompasses one having a shape near hemispherical, too.

The retainer 3 preferably allows to adjust the position of the antenna element 4. The retainer 3 shown has an arcuate guide rail 3*a* extending along the outer periphery of the lens 2, and a support arm 3*b* guided by the guide rail 3*a* to a desired position and locked after positioned. The antenna element 4 is mounted on the support arm 3*b* which is curved along the spherical surface of the lens 2 so that its position is adjustable in the longitudinal direction of the arm 3*b*. Thus, the antenna element 4 can be set in a position where the radio wave capturing efficiency is high (at or near the focal point).

The number of the antenna elements 4 is not particularly limited. For example, it may be one to receive radio waves from a single geostationary satellite. Or the number may be plural to form a multibeam antenna to receive radio waves from a plurality of geostationary satellites. Receiving and transmitting radio waves is possible by increasing the number of antenna elements.

For the mounting portion 5, various forms are conceivable. The mounting portions 5 shown in FIG. 1 and having hooking holes 5*a* allow the antenna device to be hung on screws 6 tightened into e.g. an outer wall A of a building.

Figure 3:
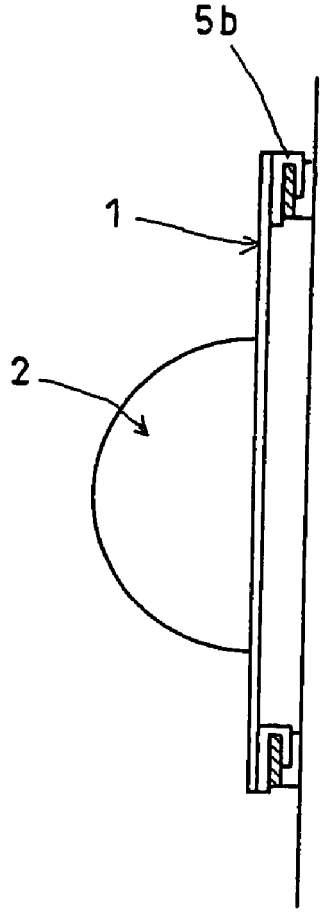
FIG. 3 is a side view showing another example of the mounting portion.
Figure 4:
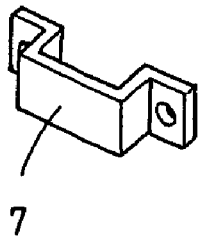
FIG. 4 is a perspective view showing an example of hooking.
Figure 5:
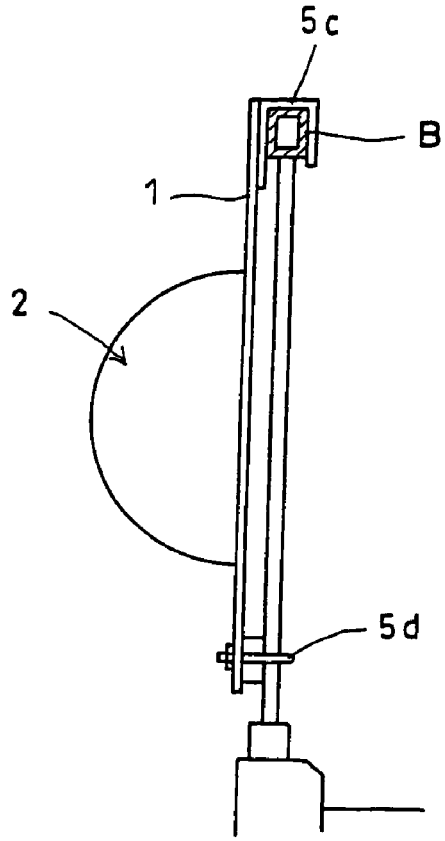
FIG. 5 is a side view showing an example of mounting on a fence of a veranda.
Figure 6:
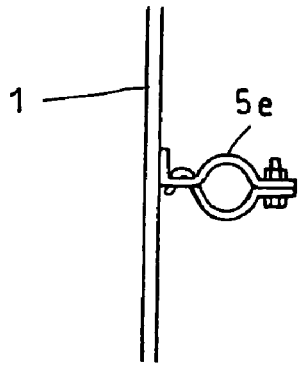
FIG. 6 is a plan view of a mounting tool using a half-cut clamp.

A suitable mounting means may be selected from among known ones, such as providing hooks 5*b* shown in FIG. 3 on the back of the reflecting plate 1 so as to be engaged in hook receivers 7 screwed to a wall surface as shown in FIG. 4, providing a large hook 5*c* on the back of the reflecting plate 1 so as to be hooked to a handrail B of a veranda, and further using a U bolt 5*d* as necessary, and fastening the device to a pole of a TV antenna or a vertical bar of a fence by means of half-cut clamps 5*e* as shown in FIG. 6.

If the antenna device is mounted to a wall surface or the like by such mounting means so that the reflecting plate 1 extends substantially vertically, it can receive only radio waves from one side (front side) of the reflecting plate. But still, radio waves can be transmitted and received to and from a geostationary satellite or other stationary antenna device without any problem.

If the reflecting plate 1 is mounted inclined, e.g. placed on an inclined roof and tied down with wire, no pedestal or the like is needed. In this case, the effect of reduction in the installation space is small compared with the arrangement in which the reflecting plate is arranged vertically. But it is advantageous in that the space over a roof which is usually not used can be used.

Figure 8:
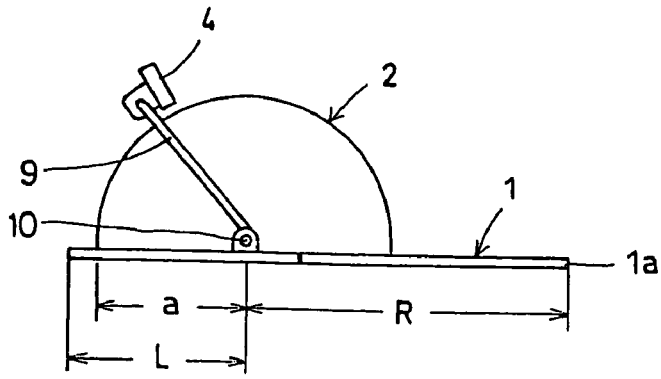
FIG. 8 is a side view of the antenna device.
Figure 9:
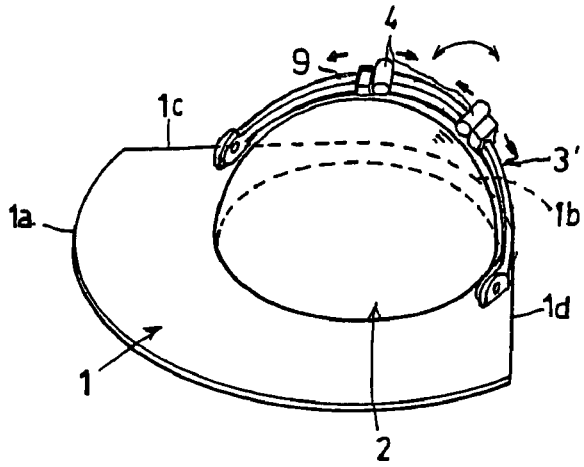
FIG. 9 is a perspective view of the antenna device.

Next, the second embodiment of the radio wave lens antenna device of this invention will be described with reference to FIGS. 7–9.

As shown in these figures, with this antenna device, too, a hemispherical Luneberg lens 2 is fixed to a reflecting plate 1, and antenna elements 4 are retained by a retainer 3' provided on the reflecting plate 1 so as to be located near the spherical surface of the lens.

The reflecting plate 1 has a fan-like shape defined by a large arcuate edge 1*a* having a larger radius than that of the lens 2, a small arcuate edge 1*b* arranged near the outer periphery of the lens 2 opposite the large arcuate edge 1*a*, and right and left straight edges 1*c* and 1*d* that connect the ends of the arcuate edges 1*a* and 1*b*. But it is not limited to this shape, provided it can reflect radio waves from the communicating partner and any non-functional areas that do not contribute to the reflection of radio waves is minimized.

The cut surface (circular flat surface) of the hemispherical Luneberg lens 2 cut in half is fixed to the reflecting plate 1 e.g. by bonding. The lens 2 has its center on the center of curvature of the large arcuate edge 1*a*. Thus, it is mounted on the reflecting plate 1 offset toward the small arcuate edge 1*b*.

The retainer 3' preferably allows to adjust the position of the antenna element 4. The illustrated retainer 3' has an arch-like support arm 9 straddling the lens 2. The antenna elements 4 are mounted on a support arm 9 so that their position is adjustable in the longitudinal direction of the arm 9. The support arm 9 has pivots 10 (whose axes are on a line that passes the center of the lens 2) that are parallel to the reflecting surface of the reflecting plate 1. The antenna elements 4 are adapted to be located at a position where the radio wave capturing efficiency is high (near the focal point) by combining the pivoting motion of the support arm 9 about the pivots 10 and their sliding motion on the arm 9. Of course, the retainer 3' is not limited to the illustrated form.

Figure 7:
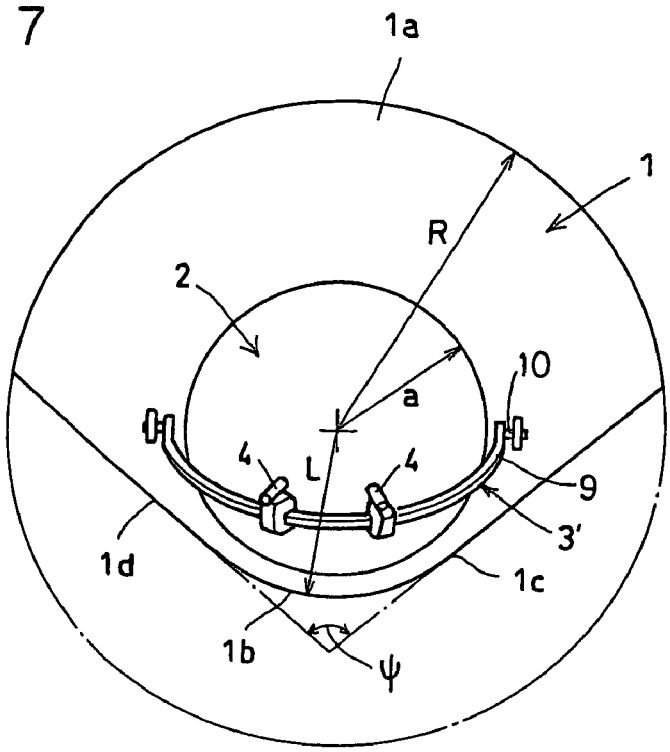
FIG. 7 is a plan view showing a second embodiment of the antenna device of this invention.

This radio wave lens antenna device can be made compact by removing the chain-line portion of a conventional circular reflecting plate as shown in FIG. 7. But if it is used for a plurality of geostationary satellites, and if the reflecting plate is too small, the transmitting and receiving performance will lower markedly. Thus, optimal shape and size of the reflecting plate have been studied. Its shape and size slightly differ according to the satellite used and the place and method at and by which the antenna is used. Table 1 shows design examples corresponding to the area of use and the number of target satellites. The a in this table indicates the radius of the lens shown in FIG. 7 and R indicates the diameter of the functional portion of the reflecting plate. The angle $\phi$ of the fan is the aperture angle when the reflecting plate is symmetrical in view of the appearance for the design examples 1 and 2, and is the aperture angle when it is asymmetrical for the design examples 3–11.

Existing Japanese satellites are described below.

| | |
|---|---|
| BSAT-2a | 110° of east longitude |
| JCSAT-110 | 110° of east longitude |
| Superbird D | 110° of east longitude |
| JCSAT-4A | 124° of east longitude |
| JCSAT-3 | 128° of east longitude |
| N-STARa | 132° of east longitude |
| S-STARb | 136° of east longitude |
| Superbird C | 144° of east longitude |
| JCSAT-1B | 150° of east longitude |
| JCSAT-2 | 154° of east longitude |
| Superbird A | 158° of east longitude |
| Superbird B2 | 162° of east longitude |

TABLE 1

| | District | Target Satellite | Radius R of reflection meter | Aperture angle $\psi$ |
|---|---|---|---|---|
| Design Ex. 1 | Whole country | All | a × 2.19 | 130° |
| Design Ex. 2 | Main island Shikoku Kyushu | All | a × 1.89 | 104° |
| Design | Whole | Satellites at 110°, 124°, | a × 2.19 | 101° |

TABLE 1-continued

| | District | Target Satellite | Radius R of reflection meter | Aperture angle ψ |
|---|---|---|---|---|
| Ex. 3 | country | 128°, 132°, 136°, 150°, 154° of E. long. | | |
| Design Ex. 4 | Main island Shikoku Kyushu | Satellites at 110°, 124°, 128°, 132°, 136°, 150°, 154° of E. long. | a × 1.89 | 85° |
| Design Ex. 5 | Whole country | Satellites at 110°, 124°, 128° of E. long. | a × 2.19 | 57° |
| Design Ex. 6 | Main island Shikoku Kyushu | Satellites at 110°, 124°, 128° of E. long. | a × 1.89 | 42° |
| Design Ex. 7 | Sapporo | All | a × 1.93 | 71° |
| Design Ex. 8 | Tokyo | All | a × 1.63 | 80° |
| Design Ex. 9 | Osaka | All | a × 1.52 | 82° |
| Design Ex. 10 | Fukuoka | All | a × 1.41 | 82° |
| Design Ex. 11 | Naha | All | a × 1.25 | 93° |

The actual radius R of the reflecting plate 1 is preferably longer by about one wavelength than the value calculated by the formula R=a/cos θ to prevent scattering of radio waves at the edge. The radius L of the small arcuate portion is also preferably longer by about one wavelength than the radius a of the lens 2.

The shape of the reflecting plate may not be fan-shaped provided compactness is not impaired. The radii R and L may be longer that the values considered to be preferable. The aperture angle ϕ may also be larger than the values shown in Table 1.

Figure 10:
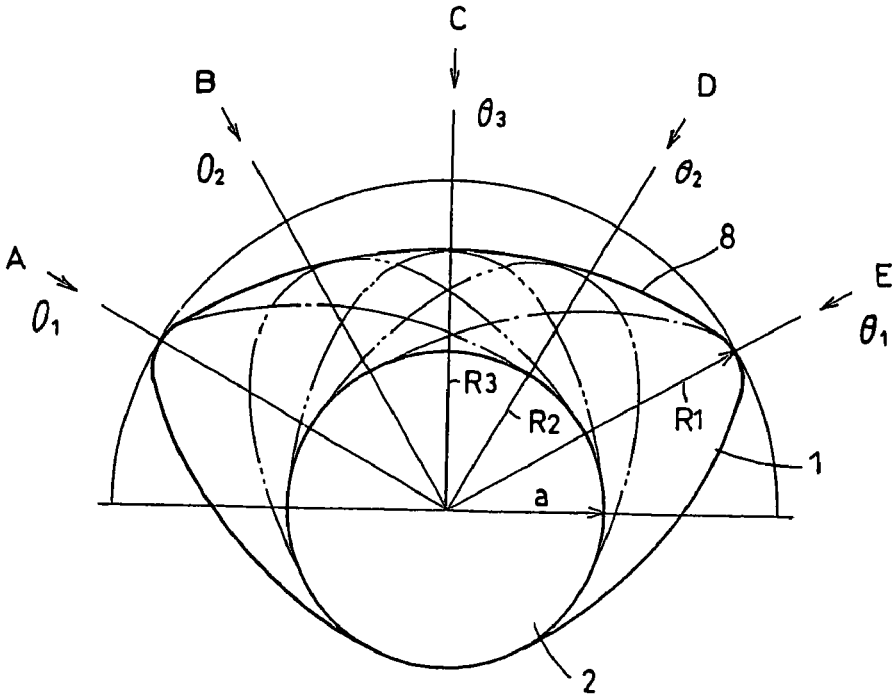
FIG. 10 is an explanatory view of a method of determining the shape of a reflecting plate.

FIG. 10 explains how ideal shape is determined if the reflecting plate 1 is of a nationwide accommodated type. In this figure, radio waves are supposed to come from every one of the directions A–E. Here, the incident angles θ1 of radio waves from A and E are equal to each other, and the incident angles θ2 of radio waves from B and D are also supposed to be equal to each other. Further, it is supposed that the relation of θ1>θ2>θ3 (wherein θ3 is the incident angle from the direction C) is met.

Under these conditions, if light is hit on the lens 2 at the angle of θ1 from the directions opposite to A and E, half of an ellipse having a major axis 2R1 and a minor axis 2*a* is projected on the reflecting surface. If light is hit on the lens 2 at the angle of θ2 from the directions opposite to B and D, half of an ellipse having a major axis 2R1 and a minor axis 2*a* is projected on the reflecting surface. If light is hit at the angle of θ3 from the direction opposite to C, half of an ellipse having a major axis 2R3 and a minor axis 2*a* is projected. Thus, the respective ellipses are connected together by an envelope 8. The deformed fan shape (Mounting portions or the like for the element retainers are separately needed. Also, if the dielectric constant of the lens is shifted from the formula (1), shape correction corresponding to the shift may be necessary.) thus drawn as shown by solid line will be an optimum shape. According to the antenna installation point, the envelopes 8 may be concavely curved, or the fan shape may be asymmetrical. If the envelopes 8 are concavely curved, ellipses at both ends may be connected together by straight lines. In this case, since the envelopes are inside the straight edges, there will be no trouble in reflecting radio waves.

Figure 11:
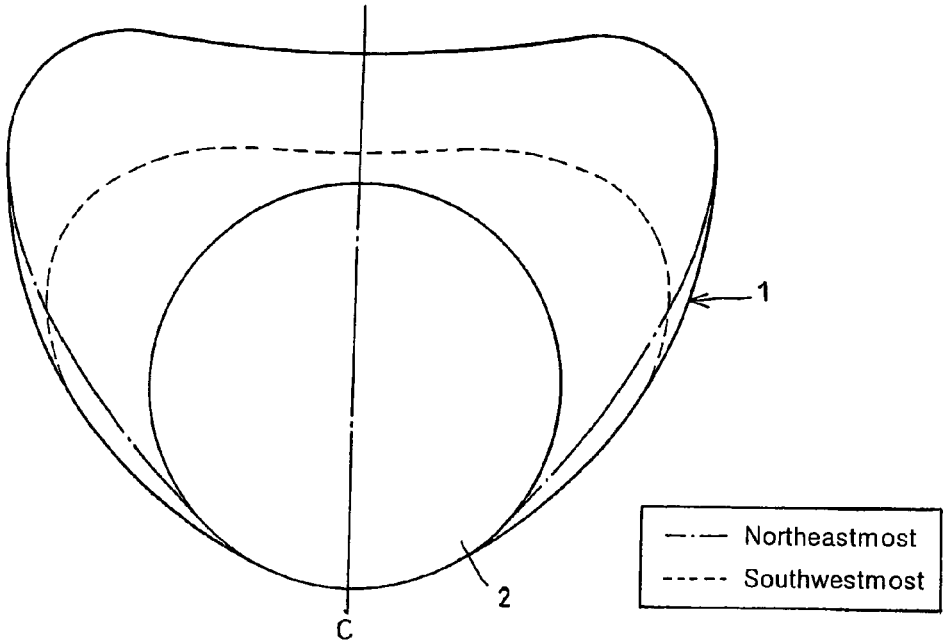
FIG. 11 is a view showing an optimum shape for a nationwide-accommodated type reflecting plate.
Figure 16:
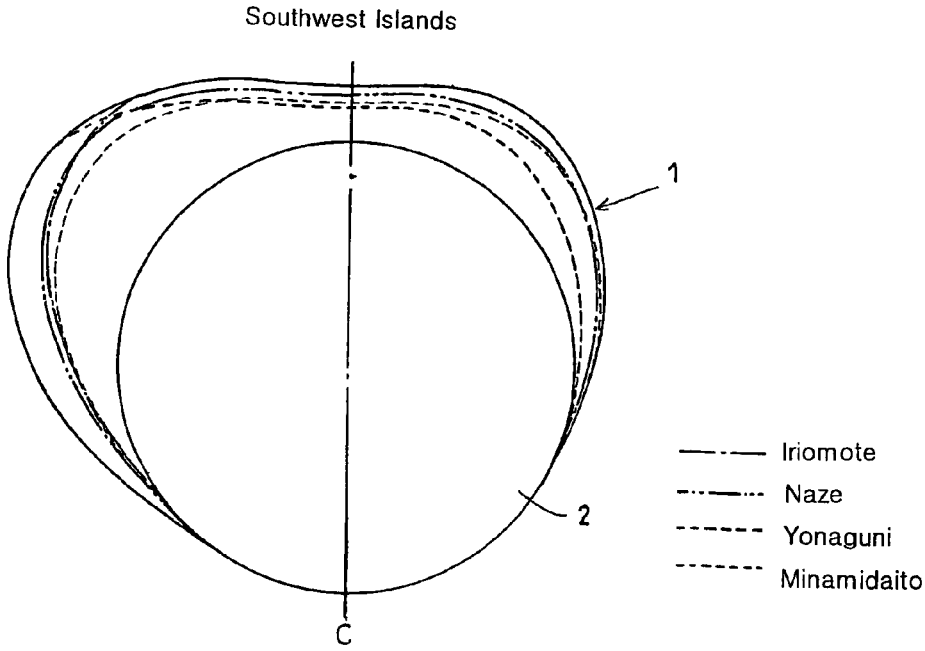

FIG. 11 is a specific example of a nationwide-accommodated type symmetrical reflecting plate designed under the above concept. In the figure, the one-dot chain line and the chain line show shapes of symmetrical reflecting plate determined to accommodate to all of the existing satellites at the north-easternmost point and the south-westernmost point in Japan, respectively. By superposing these two figures to form a reflecting plate 1 containing both figures and shown in a solid line, it can be used all over Japan as a common reflecting plate. The shape of the reflecting plate at the north-easternmost point corresponds to one in which the right half portion of FIG. 12 with respect to the line C is made symmetrical. The shape of the reflecting plate at the south-westernmost point corresponds to one in which the left half portion of FIG. 16 with respect to the line C is made symmetrical.

The ideal shape of a district-accommodated type reflecting plate varies with the number and positions of the satellites to be captured and the place where the antenna is used. These examples are shown in FIGS. 12–16.

Figure 12:
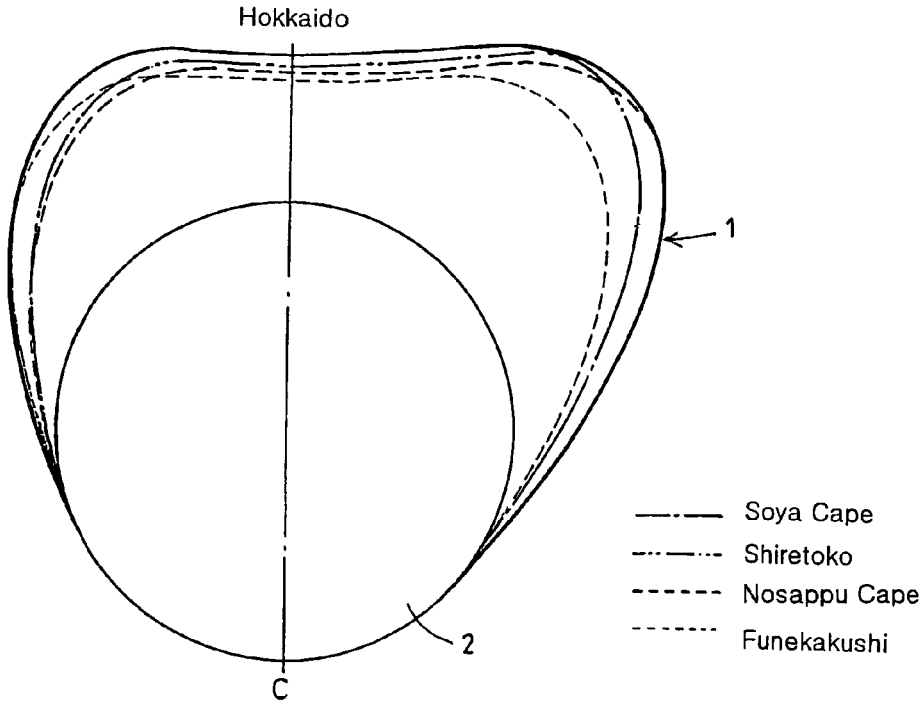
FIGS. 12–16 are views showing locally accommodated type reflecting plates, FIG. 17(*a*) is a side view of a third embodiment of the radio wave lens antenna device of this invention, FIG. 17(*b*) is a plan view of the device, FIG. 18(*a*) is a side view of a fourth embodiment of a radio wave lens antenna device, FIG. 18(*b*) is a plan view of the device, FIG. 19(*a*) is a side view of still another embodiment of the radio wave lens antenna device, FIG. 19(*b*) is a plan view of the device, FIG. 20(*a*) is a plan view of an embodiment of the pointing map, FIG. 20(*b*) is a side view of the map, FIG. 21(*a*) is a plan view showing an example of use of the map of FIG. 20, FIG. 21(*b*) is a side view of the same.
Figure 13:
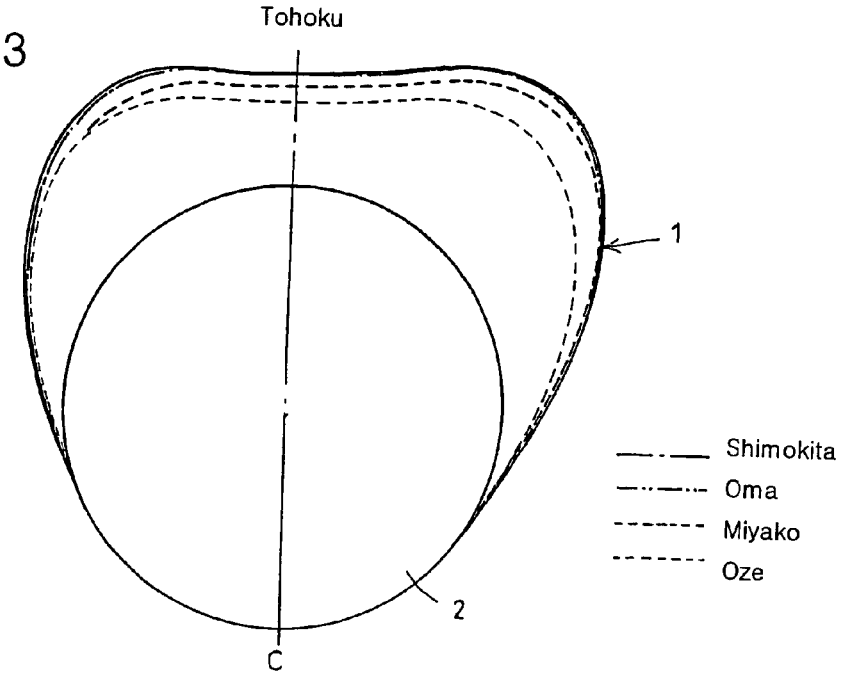
Figure 14:
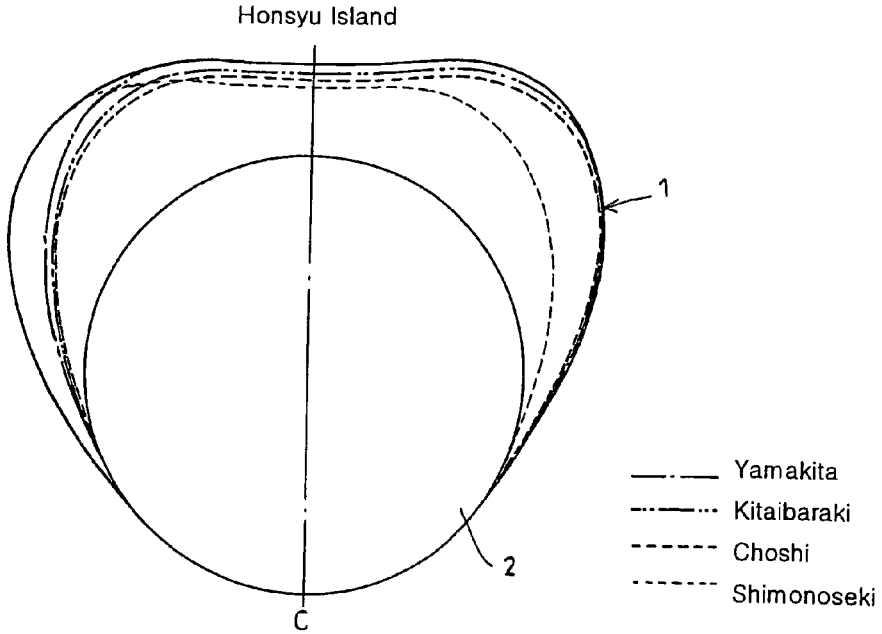
Figure 15:
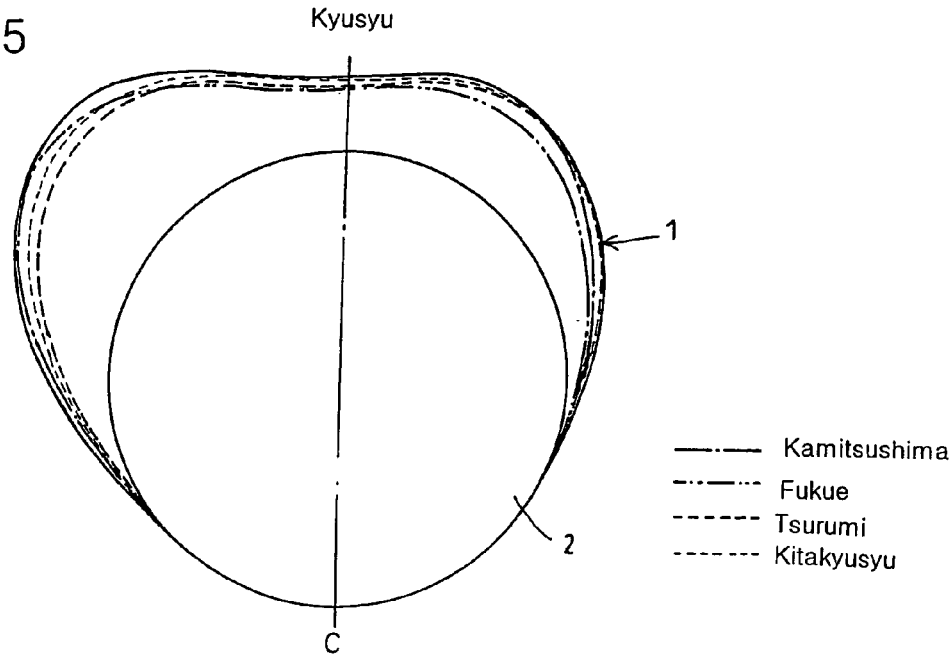

As shown in FIG. 12, by superposing several figures obtained for specific regions and drawing the shape of the solid line, which includes all the figures superposed based on the same concept as in FIG. 11, a reflecting plate accommodated e.g. to Hokkaido is made (for other regions, too, it can be formed based on the same concept). Also, by superposing the shape of a reflecting plate accommodated to Hokkaido as shown in FIG. 12 and the shape of a reflecting plate accommodated to Tohoku as shown in FIG. 13 to form a shape including the figures for the respective regions, a common reflecting plate for Hokkaido and Tohoku districts is obtained. The district accommodated type reflecting plate and multiple-district accommodated type reflecting plate can be formed by reversing the larger half portion figure and replacing it with the smaller portion figure, a good-looking symmetrical reflecting plate can be formed. For other districts, too, the concept is exactly the same. By eliminating unnecessary portions, a compact reflecting plate can be formed.

Next, the third embodiment of the antenna device of this invention and the embodiment of the pointing map will be described with reference to FIGS. 17–23.

The radio wave lens antenna device shown in FIGS. 17–20 has a hemispherical Luneberg lens 2 fixed to a reflecting plate 1 and a plurality of antenna elements 4 mounted on a support arm 9 provided on the reflecting plate 1.

The Luneberg lens 2 is made of a dielectric material, and the dielectric constants of its parts are made approximate to the value calculated using the formula (1) e.g. by forming the entire lens in a multiple-layer structure.

The antenna element 4 may be an antenna only or a combination of an antenna and a circuit board including a low noise amplifier, a frequency converter and an oscillator.

The support arm 9 is an arch type straddling the lens 2, and has element retaining portions 9*a* extending along the arcuate surface of the lens, and pivots 10 as rotation fulcrums at both ends. The pivots 10 are rotatably mounted on angle adjusters 15. In the illustrated device, the pivots 10 are on an axis that passes the center of the lens. But in order to increase the element positioning accuracy, the center of rotation of the arm 9 may be intentionally offset from the axis that passes the center of the lens.

The angle adjustors 15 shown support the pivots 10 with brackets 15*c* having graduations 15*a*. The angle adjustors 15 have locking mechanisms (not shown) for locking the support arm 9 at angular positions. The locking mechanisms have an arcuate elongated hole formed in each bracket 15*c* so as to be concentric with the pivot 10 to receive a screw mounted on the pivot 10. The screw is tightened with a butterfly nut.

Each element retaining portion 9*a* on the support arm 9 is provided with an element mounting means 11. For the element mounting means 11, an inserting type or a slide type holder is positioned at a designated position by providing a recess, projection or mark on the support arm 9, and an antenna element 4 is mounted on the holder. Using this element mounting means 11, the distances between the antenna elements are adjusted so as to correspond to the distances between the satellites.

The distances of the antenna elements 14 mounted by the element mounting means 11 are set as shown below. For example, in Japan, mainly used geostationary satellites are located 110 degrees, 124 degrees, 128 degrees, 132 degrees, 136 degrees, 144 degrees, 150 degrees, 154 degrees, 158 degrees, and 162 degrees of east longitude. Among them, in order to capture the radio waves from satellites e.g. at long. 124 and 128 degrees E., though the difference in longitude between two satellites is 4 degrees, as viewed from the antenna installation points in Japan, the distances between the satellites are about 4.4 degrees. Thus, in this case, the antenna elements may be mounted on the element retaining portions 9*a* at the intervals of 4.4 degrees (if necessary, correction angle added).

Also, as already stated, due to change in the latitude with the pivotal motion of the support arm 9, the focal point of radio waves shifts from an arc concentric with the element retaining portions and in the direction facing the satellites also shifts according to the installation point of the antenna. Thus, it is preferable to provide a fine adjustment mechanism for the azimus and the turning angle for polarized wave adjustment between the antenna elements 4 and the support arm 9. Or else, support arms for respective regions may be prepared which allow the antenna elements to be positioned and mounted at intervals corresponding to the average distances between satellites at different regions, and one of them may be selected. The support arms for respective regions include ones in which part of the arms are replaceable and by replacing only part of them, the antenna elements can be positioned at an optimum point for specific region.

Figure 17:
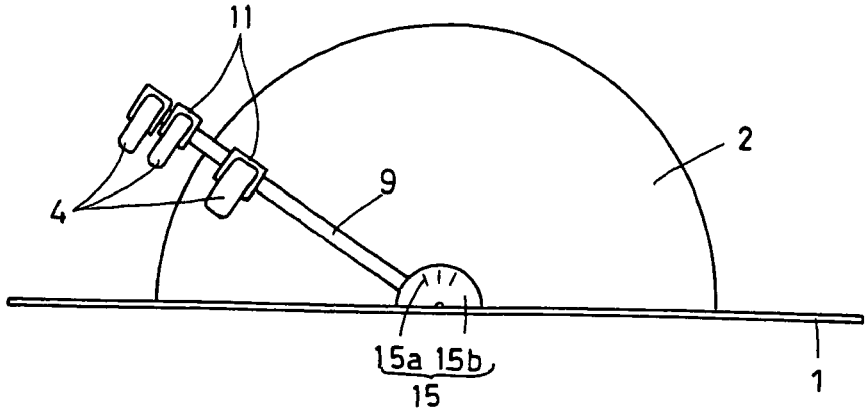
Figure 17:
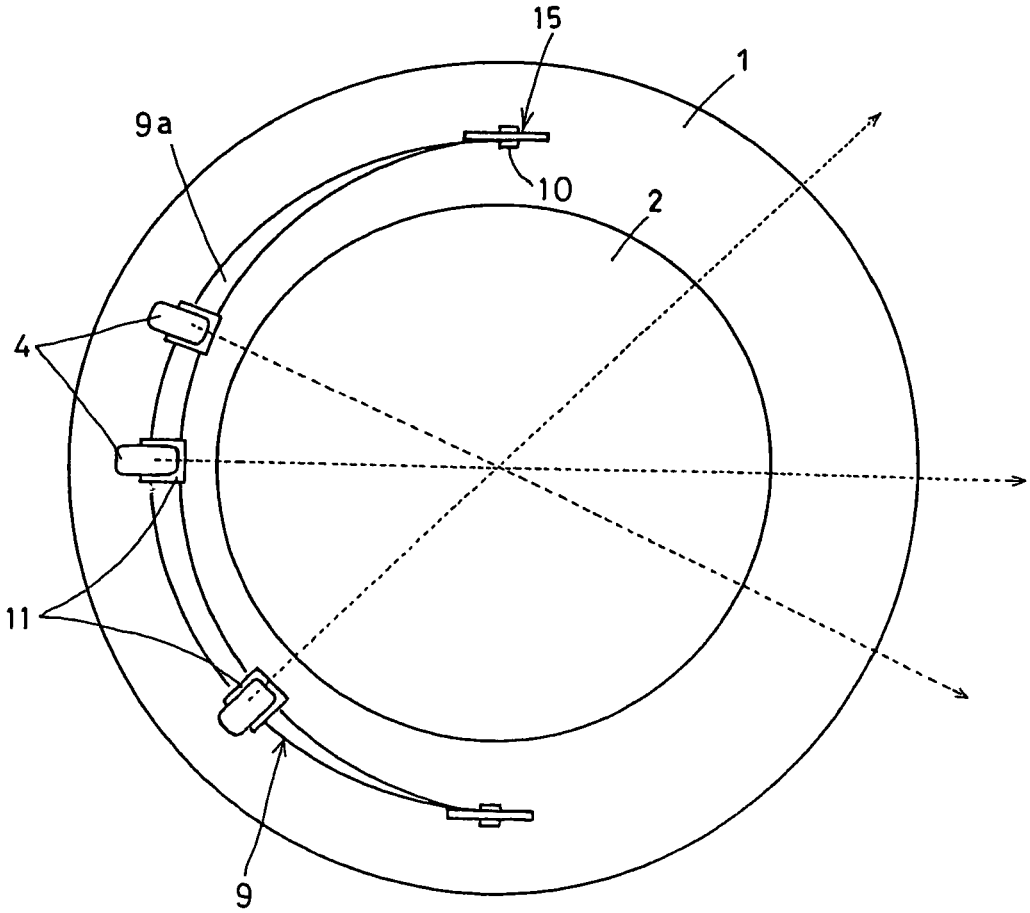

Hereinbelow, it will be described how the radio wave lens antenna device of FIG. 17 is installed.

1) A mark for adjusting the direction is put on the reflecting plate 1 (for example, S that indicates due south direction, or N that indicates due north for use in the Southern Hemisphere). This mark may be put beforehand. But the positional relationship between the mark and the mounting point of the antenna element 4 has to be fixed.
2) As many antenna elements as the number of target satellites are prepared and mounted on suitable points on the arm.
3) According to the latitude and longitude of the antenna installation point, the elevation is determined by referring a table or a map, and the arm is adjusted to the elevation.
4) The antenna is installed so that the due south mark will face south.

Now it is possible to substantially capture all the satellites.

5) While receiving radio waves from the respective satellites, the angles of the antenna elements are adjusted to bring the receiving level to maximum. Further, the positions of the antenna elements are finely adjusted (for azimus and elevation) to set and fix them so that the receiving level will be maximum. This operation is carried out for all the antenna elements.

With this arrangement, it is possible to comprehensively and easily capture a plurality of satellites. Thus the positioning of the antenna elements is easy.

Figure 18:
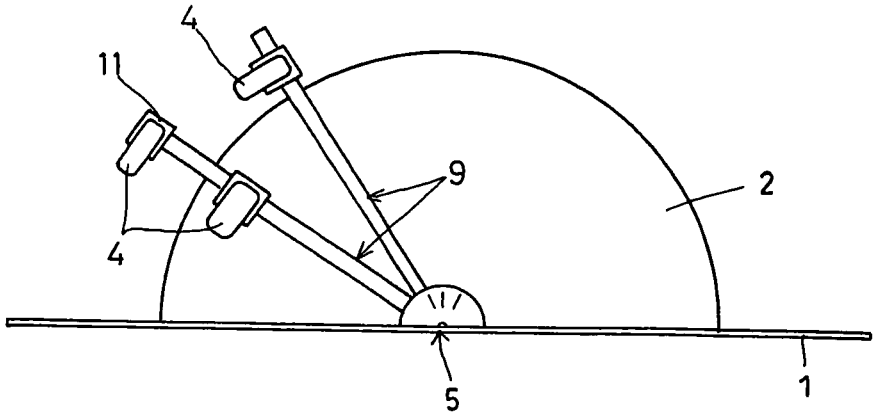
Figure 18:
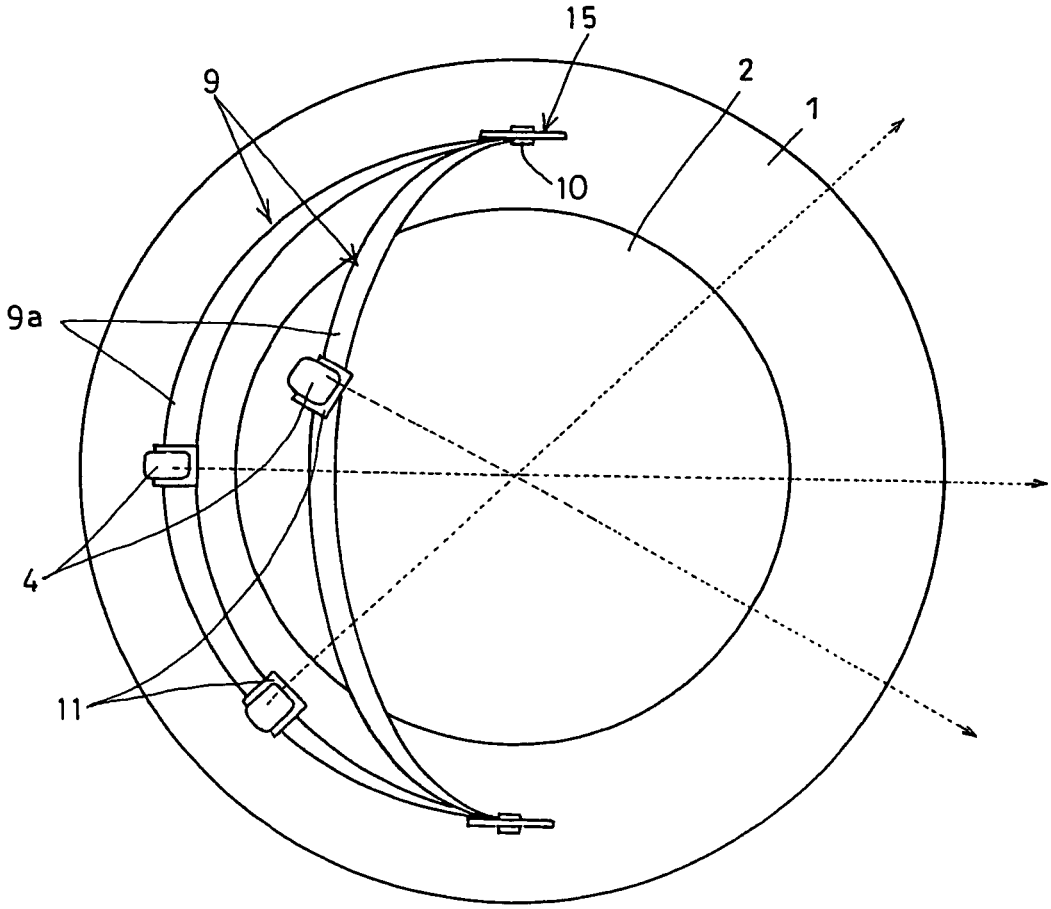

FIG. 18 shows the fourth embodiment. The distance of 4.4 degrees between the satellites is rather narrow. Thus, to mount the antenna elements on the same support arm at this distance, small antenna elements are needed. If compactness that meets this requirement is not achieved, interference would occur between the adjacent antenna elements. Thus, one has to give up capturing one of the satellites. The device of FIG. 18 has two support arms 9 having pivots on a common axis. By providing a plurality of arms and mounting the antenna elements 4 separately on the arms 9, it is possible to increase the distances between the adjacent antenna elements, and thus to obviate the abovesaid trouble.

Figure 19:
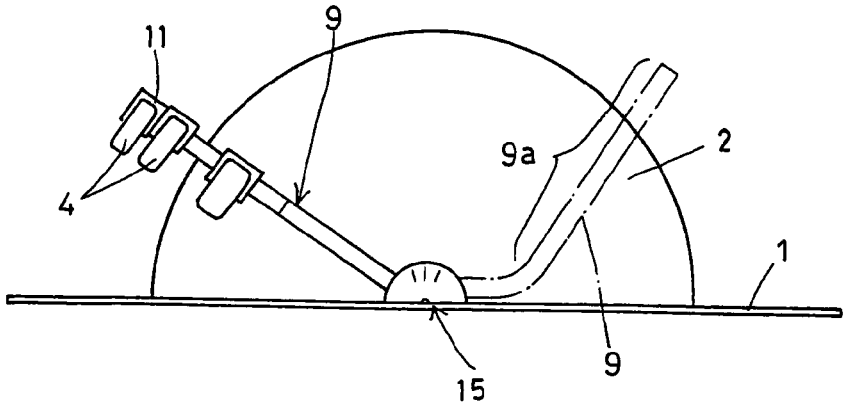
Figure 19:
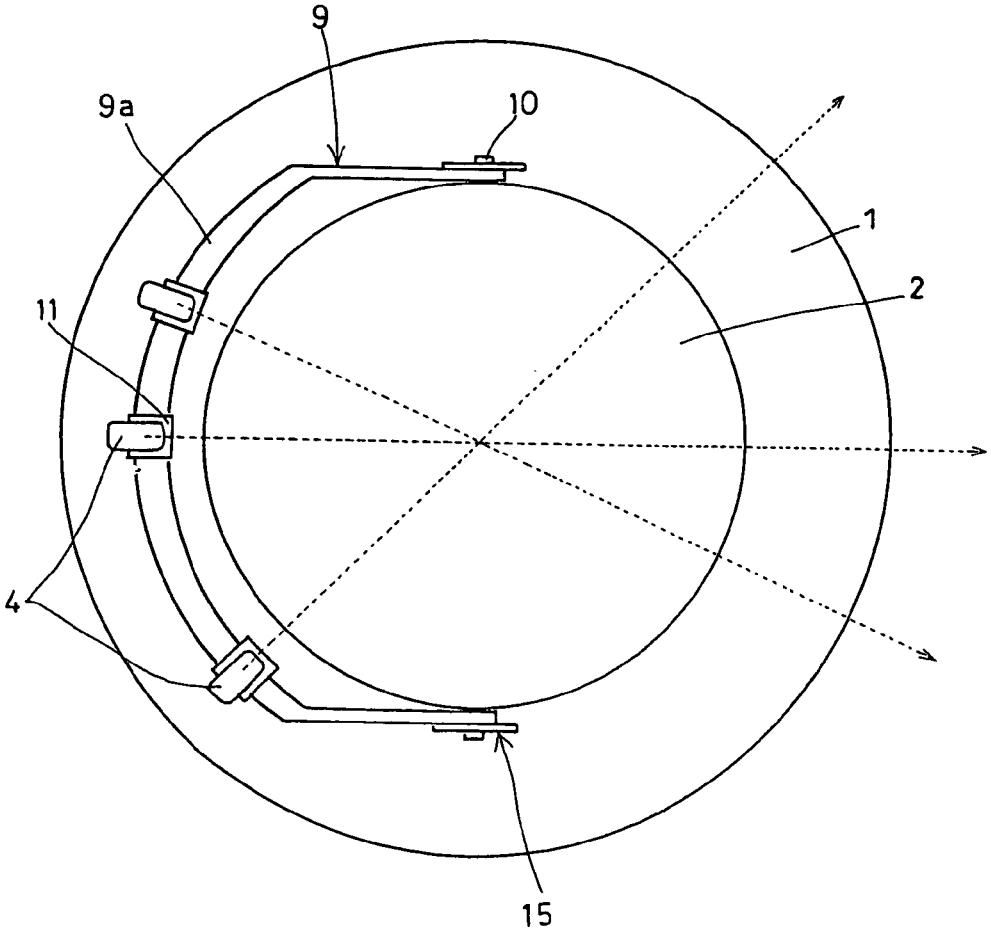

FIG. 19 shows an example of modified support arms. The element retaining portion 9*a* of each support arm 9 is in the form of an arc concentric with the lens 2 to make constant the focal distance of radio waves. The region off from the element retaining portions 9*a* does not have any influence on the focal distance. Thus both ends of the support arm 9 may be shaped as shown in FIG. 19. By shaping them as shown in FIG. 19, the distance between both ends of the arm shortens, so that compactness is achieved. Also, as shown by chain line in FIG. 19(*a*), both ends of the arms 9 may be bent as viewed from one side. This shape is effective in arranging the element retaining portions 9*a* so as to ideally extend along the positioned points of the antenna elements.

Figure 20:
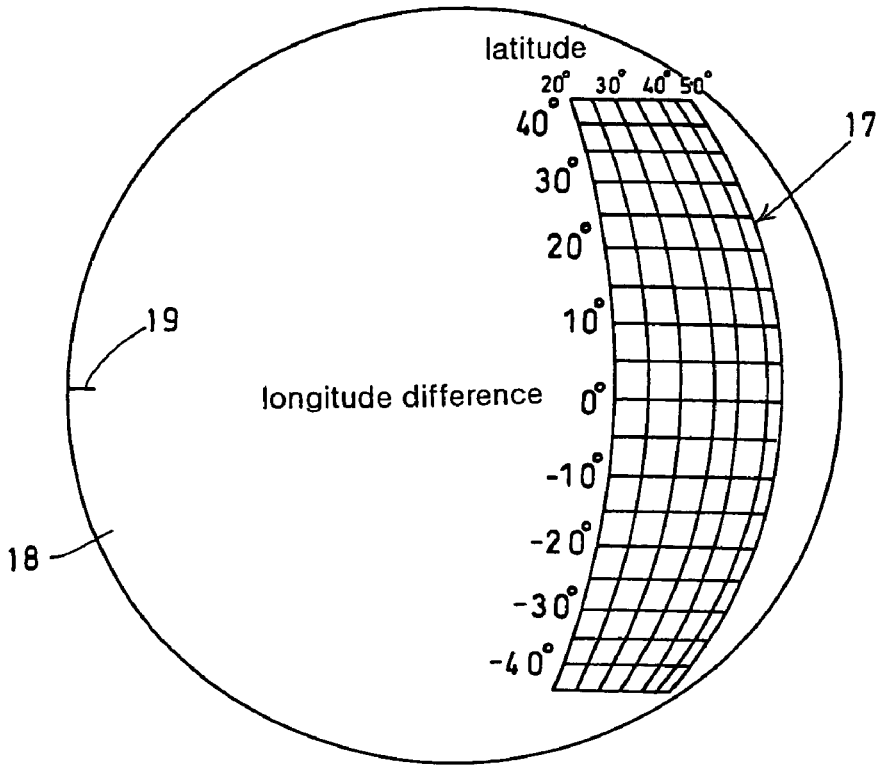
Figure 20:
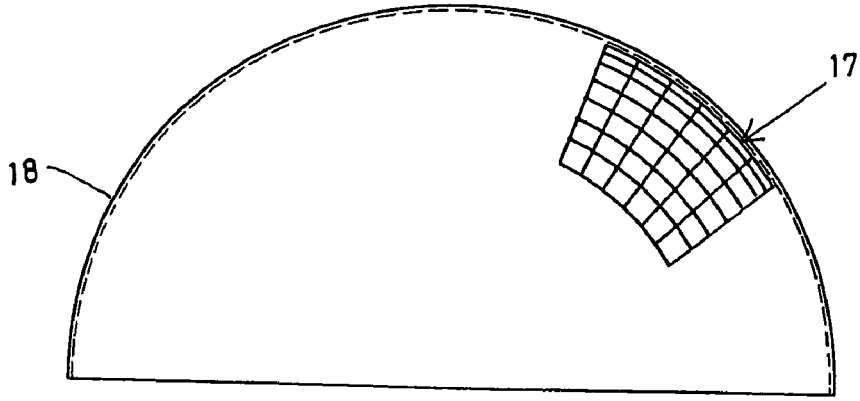

Next, FIG. 20 shows an embodiment of the pointing map.

In this invention, figures in which loci of equal latitude and equal longitude differences are drawn are referred to as pointing maps.

For example, let us assume that the longitude of the antenna installation point is $\phi$, its latitude is $\theta$, the longitude of a satellite is $\phi s$, and the difference in longitude $\Delta\phi=\phi-\phi s$.

The equal longitude difference lines are loci drawn on a hemispherical surface obtained by changing $\theta$ while keeping $\Delta\phi$ constant.

The equal latitude lines are loci drawn on the hemispherical surface and obtained by changing $\Delta\phi$ while keeping $\theta$ constant.

This pointing map 17 is drawn on a radome 18, which is then put on the hemispherical lens to determine the satellite capturing position from the latitude of the antenna installation point and the difference between the longitude of the antenna installation point and the longitude where there is the target satellite.

A specific method of installing the antenna elements by use of the pointing map of FIG. 20 will be described with reference to FIG. 21.

1) The lens antenna 2 is installed on the reflecting plate 1, and the radome 18 is put thereon.
2) Not only the pointing map 17 but a pointing mark 19 are drawn on the radome 18 beforehand.
3) The radome 18 is positioned so that the pointing mark 19 will face the below-described azimuth mark 20.
4) To the reflecting plate 1, an azimuth mark for indicating the due south direction (S) is affixed (if installed on the Southern Hemisphere, a mark N which shows the due north, is put).
5) If necessary, the satellite direction with reference to S (or N) may be marked according to the longitude of the target satellite.
6) In this state, an antenna element 4 (primary radiator) for the target satellite is temporarily fastened to the antenna installation point on the pointing map 17.
7) The same operation is carried out for the antenna elements for all the target satellites.
8) After confirming that the pointing mark 19 is registered with the azimuth mark 20, the reflecting plate 1 is moved so that the azimuth mark 20 will face south (or north).
9) The angles of the antenna elements are adjusted while receiving radio waves from the respective satellites so that the receiving level will be maximum. Further, the positions of the antenna elements are finely adjusted to set and fix them so that the receiving level will be maximum. This operation is carried out for the antenna elements for all the satellites.

By using this pointing map, satellites can be captured reliably and easily, and it is possible to simplify positioning of the antenna elements.

Also, by drawing the pointing map on the surface of e.g. a radome, no special tool for adjusting the direction is necessary. This is economically advantageous.

Here, description was made about the case in which the pointing map 17 is drawn on the radome 18, which has a function as an antenna cover. But it may be a temporary jig used only during positioning of the antenna elements. In this case, after installation of the antenna, the pointing map cover has to be removed. Thus, only the side where the map is drawn is left and the map may be drawn on a cover of a quarter sphere.

Also, if the lens used needs no radome, the map may be printed on the surface of the lens. Also, a seal or the like on which is printed the map may be sticked to the lens.

Figure 21:
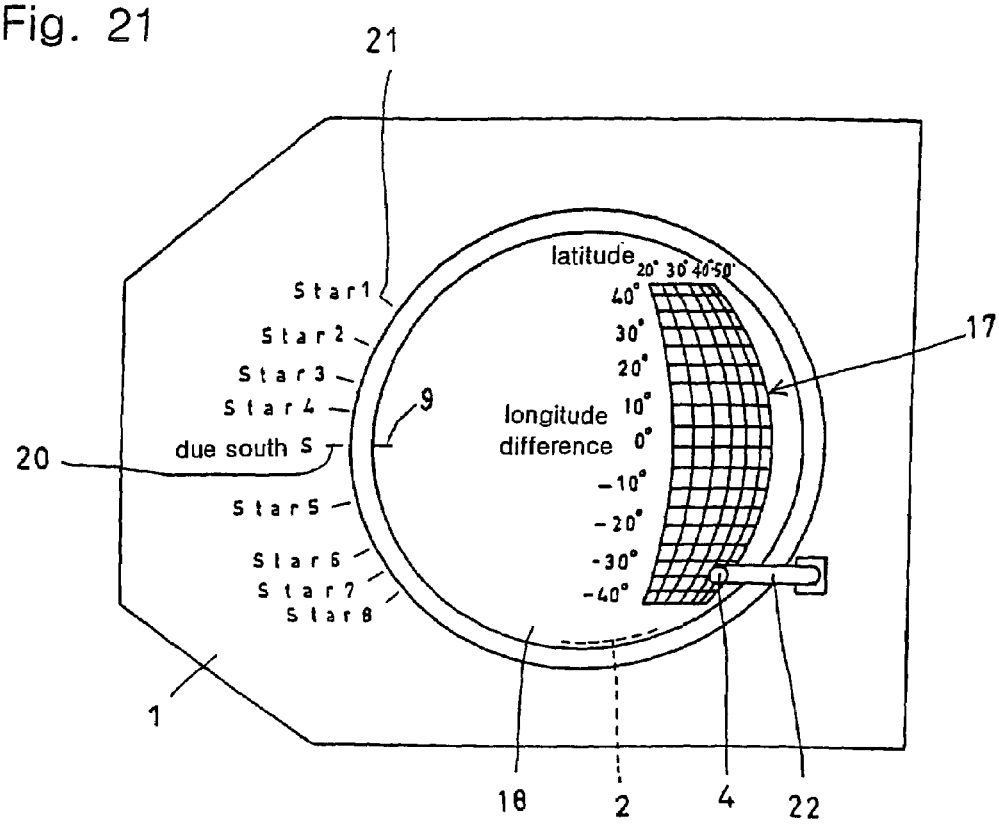
Figure 21:
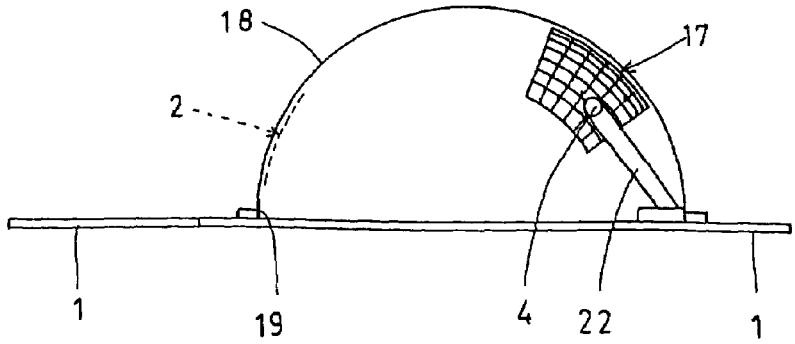
Figure 22:
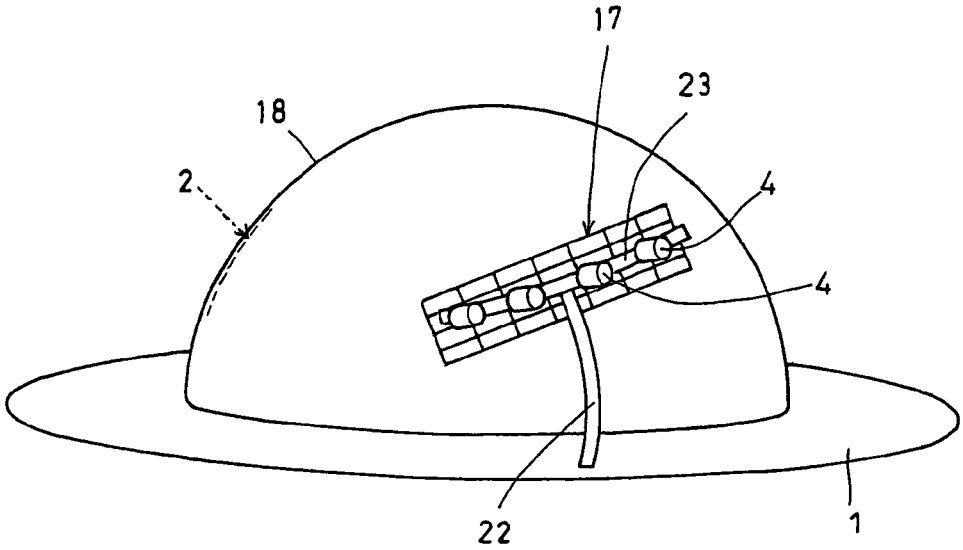
FIG. 22 is a perspective view showing another example of use of the pointing map.

Also while in FIG. 21 one antenna supporting pole 22 is shown for one antenna element 4, an arm type as shown in FIGS. 17–19 may be used. Also, as shown in FIG. 22, a support tool may be employed in which the support pole 22 and a small arm 23 supporting a plurality of antenna elements 4 are combined. In this case, since the shape of the arm may not completely coincide with the locus of the map, the individual antennas are preferably provided with fine adjustment mechanisms for the azimuth and elevation. This will be suited for reliable installation, which is an advantage inherent to the pointing map.

Figure 23:
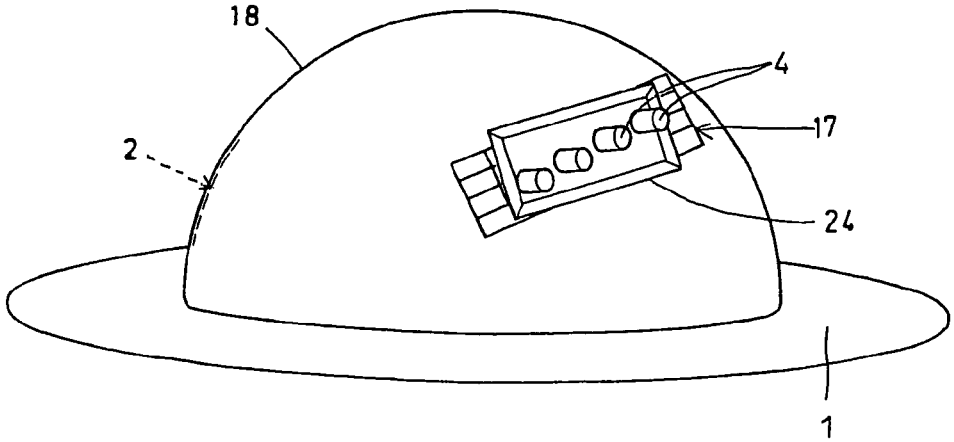
FIG. 23 is a perspective view showing still another example of use of the pointing map, FIG. 24(*a*) is a side view of a conventional Luneberg antenna device having a circular reflecting plate, FIG. 24(*b*) is a plan view of the same.
Figure 24:
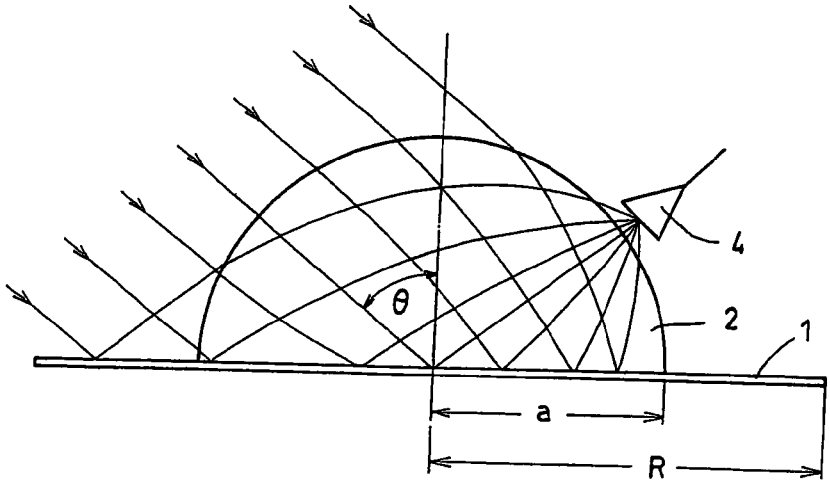
Figure 24:
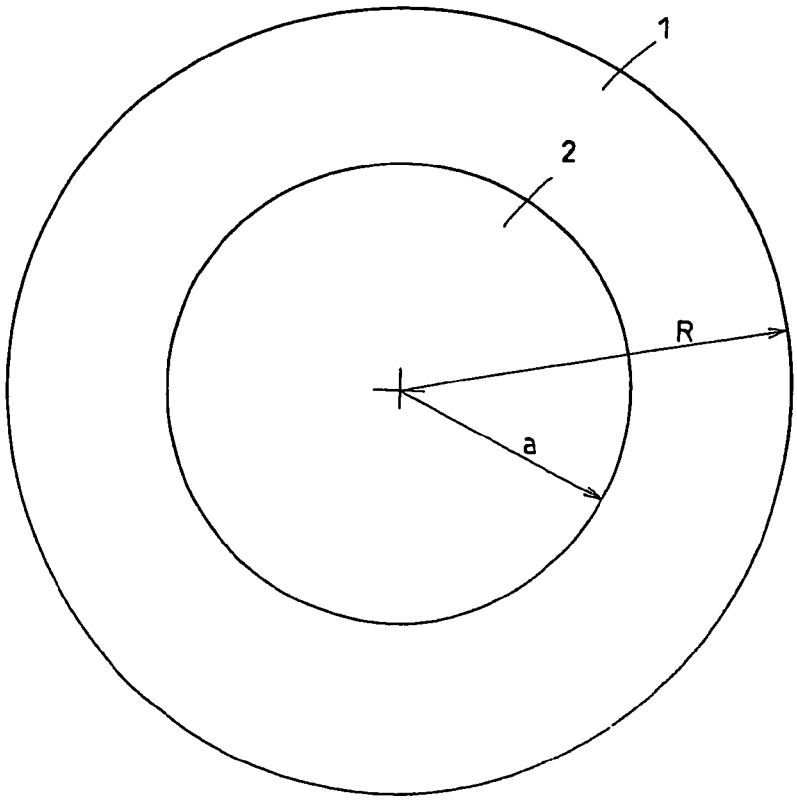
Figure 25:
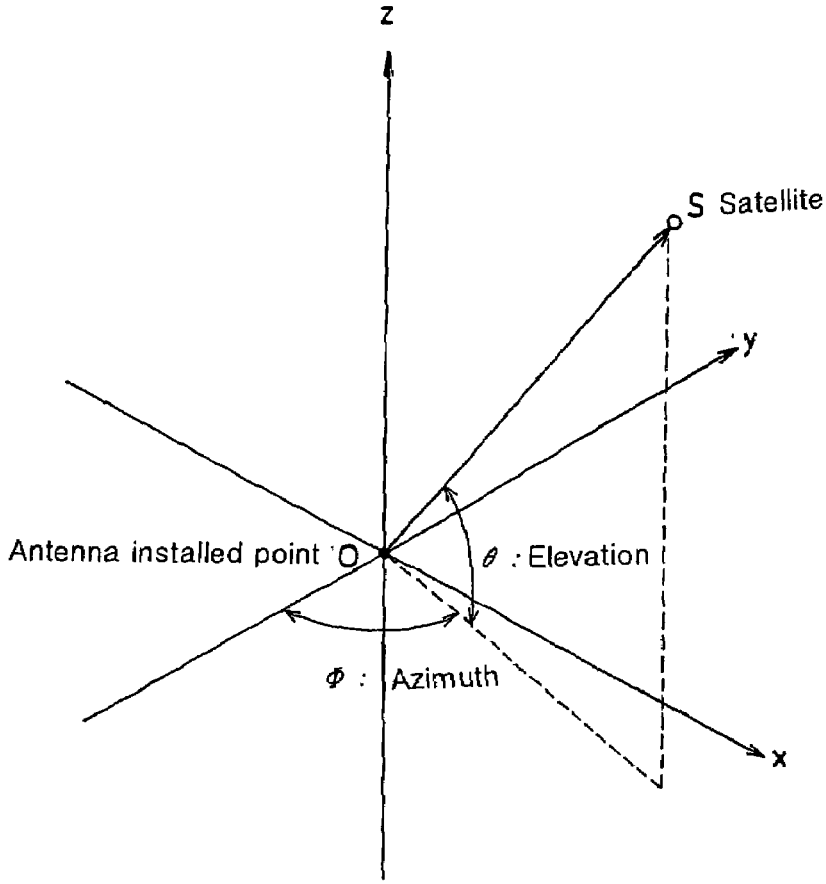
FIG. 25 is an explanatory view of the azimuth and elevation angle of a satellite as viewed from the point where the antenna is installed.

Further, as shown in FIG. 23, the lens antenna device may be a surface mounting type in which individual antenna elements 4 are fixed to desired positions in an element holder 24 (positions corresponding to the positions marked on the map). The element holder 24 is of such a size as to cover the pointing map 17 or cover only the range where there exist the corresponding antenna elements so as to be mountable on the surface of the radome 18 or are integrally formed with the radome. For the holder 24, by providing many inserting holes for elements or element mounting tool at fine pitches, it is possible to select a hole at a desired position and mount an element or element mounting tool in the hole at a desired position. In this case, by using the element mounting tool, it is possible to provide a fine adjustment mechanism for the azimuth and elevation thereon.

The antenna device of this invention may be a type that retains the antenna elements individually or a type that retains several of them together.

EFFECT OF THE INVENTION

As described above, in the radio wave lens antenna device of the first embodiment of this invention, the reflecting plate is installed substantially vertically. Thus it is less bulky than a parabolic antenna or the type in which the reflecting plate is installed horizontally. Thus, it needs no large installation space. Also, it is possible to install it on a usually unused wall surface, outer surface of a veranda fence or a pole provided on a rooftop or a wall surface. This relaxes restriction on installation and increases freedom of selection of the installation location, and it can be compactly installed at a place where it will not be an obstacle.

Also, since the reflecting plate is arranged vertically, it is possible to omit measures against snowfalls and staying raindrops.

Besides, the reflecting plate can be used as a mounting tool. Thus no special supporting tool or mounting tool is needed. Also, since surface support using the reflecting plate is possible, it is possible to expand the support area, thus improving stability of support. Further, since the hemispherical lens is high in strength and less likely to be affected by wind pressure, it is possible to improve wind resistance, too.

With the radio wave lens antenna device of the second embodiment of this invention, portions of the reflecting plate which do not contribute to radio wave reflection are omitted, leaving only portions which can respond to radio waves from directions in a predetermined range. Thus the reflecting plate can be made to a minimum size. Thus it is possible to achieve compactness, lightness in weight and lower cost. Also, the handling improves and the installation space can be reduced.

Also, the electrical properties required for the antenna can be ensured. Thus it is possible to receive radio waves from a plurality of satellites or other antennas or to receive and transmit radio waves with a smaller one than a parabolic antenna for BS or CS broadcasting.

Also, since the radio wave antenna device of the third embodiment of this invention has a plurality of antenna elements, it is possible to independently receive and transmit radio waves for a plurality of geostationary satellites. Thus it is not necessary to increase the number of antennas. Also, with the device having a pivotable support arm, a plurality of antenna elements are mounted on the support arm at intervals corresponding to the distances between satellites. By pivoting the support arm by a required angle, positioning of a plurality of antenna elements with respect to the respective satellites can be done comprehensively. Thus, adjusting work is extremely easy.

Also, with the pointing map of this invention and the antenna device using it, the elements can be positioned by visually checking the positioning points of the antenna elements (that is, satellite capturing points). Thus radio waves from satellites can be reliably and easily captured. Also, no special tool for direction adjustment is necessary. This is economically advantageous.

The invention claimed is:

1. A radio wave lens antenna device comprising a hemispherical Luneberg lens made of a dielectric material, a reflecting plate having a larger size than the diameter of said lens at a half-cut surface of the sphere of said lens, an antenna element provided at the focal point of said lens, a retainer for retaining said antenna element, and a mounting portion for mounting said antenna device on an installation portion, said reflecting plate being mounted on said installation portion so as to be substantially vertical relative to the ground.

2. A radio wave lens antenna device as claimed in claim 1 wherein said mounting portion is provided on said reflecting plate so that said reflecting plate can be mounted to a wall surface or side surface of a building.

3. A radio wave lens antenna device comprising a hemispherical Luneberg lens made of a dielectric material, a reflecting plate having a larger size than the diameter of said lens at a half-cut surface of the sphere of said lens, an antenna element provided at the focal point of said lens, a retainer for retaining said antenna element, and a mounting portion for mounting said antenna device on an installation portion, said reflecting plate being mounted on said installation portion so as to be inclined relative to the ground.

4. A radio wave lens antenna device comprising a hemispherical Luneberg lens made of a dielectric material, a reflecting plate having a larger size than the diameter of said lens at a half-cut surface of the sphere of said lens, and an antenna element provided at the focal point portion of said lens, and a retainer for retaining said antenna element, wherein said reflecting plate is formed into a noncircular shape by removing an area other than a portion which reflects radio waves from directions in a predetermined range, and wherein said Luneberg lens is mounted on said reflecting plate offset to a direction opposite to the direction in and from which said lens transmits and receives radio waves.

5. A radio wave lens antenna device as claimed in claim 4 wherein said reflecting plate has a fan-like shape defined by a large arcuate edge concentric with the center of said lens and having a larger diameter than said lens, a small arcuate edge arranged at a position near the outer periphery of said lens opposite said large arcuate edge, and side edges connecting the ends of said large arcuate edge with the ends of said small arcuate edge, or a shape enclosing such a fan.

6. A radio wave lens antenna device as claimed in claim 4, wherein said reflecting plate has a fan-like shape defined by a large arcuate edge concentric with the center of said lens and having a larger diameter than said lens, a small arcuate edge arranged at a position near the outer periphery of said lens opposite said large arcuate edge, side edges connecting the ends of said large arcuate edge with the ends of said small arcuate edge, or a shape enclosing such a fan, and the large arcuate edge of said reflecting plate is cut out so that at any portion where the radio wave incident angle is the smaller, the shorter the distance from the lens center to the edge.

7. A radio wave lens antenna device as claimed in claim 5 or 6 wherein said reflecting plate is asymmetrical.

8. A radio wave lens antenna device as claimed in claim 5 or 6 wherein said reflecting plate is symmetrical and the spread angle of said reflecting plate is 130° or less.

9. A radio wave lens antenna device comprising a reflecting plate for radio waves, a hemispherical Luneberg lens provided on said reflecting plate with the half-cut surface of the sphere along the reflecting surface, an antenna element for transmitting, receiving or transmitting and receiving radio waves, and a retainer for retaining said antenna elements in a predetermined position, said antenna element being plural so as to correspond to a plurality of communicating parties.

10. A radio wave lens antenna device according to claim 9 combined with a pointing map for a radio wave lens antenna device having a cover which is put on a hemispherical Luneberg lens, wherein the following equal latitude lines and equal longitude difference lines used as indexes for positioning antenna elements, and a pointing mark showing a reference direction for mounting said cover on said lens are drawn on the surface of said cover, assuming that the latitude of the antenna installation point is $\theta$, and its longitude is $\phi$, and the longitude of a geostationary satellite is $\phi s$ and its longitude difference $\Delta\phi=\phi-\phi s$, the equal longitude difference lines are loci on a hemispherical surface obtained by changing $\theta$ while keeping $\Delta\phi$ constant, and the equal latitude lines are loci on a hemispherical surface obtained by changing $\theta$ while keeping $\Delta\phi$ constant.

11. A radio wave lens antenna device according to claim 9, combined with a pointing map for a radio wave lens antenna device wherein the following equal latitude lines and equal longitude difference lines used as indexes for positioning antenna elements are drawn on the surface of a hemispherical Luneberg lens or on a film stuck on the surface of said lens, assuming that the latitude of the antenna installation point is $\theta$, and its longitude is $\phi$, and the longitude of a geostationary satellite is $\phi s$ and its longitude difference $\Delta\phi=\phi-\phi s$, the equal longitude difference lines are loci on a hemispherical surface obtained by changing $\theta$ while keeping $\Delta\phi$ constant, and the equal latitude lines are loci on a hemispherical surface obtained by changing $\Delta\phi$ while keeping $\theta$ constant.

12. A radio wave antenna device comprising a reflecting plate for radio waves, a hemispherical Luneberg lens provided on said reflecting plate with the half-cut surface of the sphere along the reflecting surface, an antenna element for transmitting, receiving or transmitting and receiving radio waves, and an arch type support arm that straddles said lens, wherein said antenna element being plural, further comprising means for mounting said antenna elements at intervals corresponding to the distances between geostatic satellites, provided on an arcuate element retaining portion of said support arm extending along the spherical surface of said lens, and an elevation adjusting mechanism for pivoting said support arm to a desired position about an axis passing the center of said lens.

13. A radio wave lens antenna device as claimed in claim 12 further comprising a mechanism for fine adjustment of the azimuth of said antenna elements and rotation angle for polarized wave adjustment.

14. A radio wave lens antenna device as claimed in claim 12 or 13 wherein said support arm comprises a plurality of support arms which are pivotable about a common fulcrum, said plurality of antenna elements being distributed to and mounted on said respective support arms.

15. A radio wave lens antenna device as claimed in claim 14, wherein said support arm is a deformed arm having such a shape that its both ends are non-arcuate, and an arcuate element retaining portion is provided between said non-arcuate portions, keeping a constant distance between said support arm and the spherical surface of said lens.

16. A radio wave lens antenna device as claimed in claim 12 or 13, wherein said support arm is a deformed arm having such a shape that its both ends are non-arcuate, and an arcuate element retaining portion is provided between said non-arcuate portions, keeping a constant distance between said support arm and the spherical surface of said lens.

17. A radio wave lens antenna device according to claim 12, combined with a pointing map for a radio wave lens antenna device having a cover which is put on a hemispherical Luneberg lens, wherein the following equal latitude lines and equal longitude difference lines used as indexes for positioning antenna elements, and a pointing mark showing a reference direction for mounting said cover on said lens are drawn on the surface of said cover, assuming that the latitude of the antenna installation point is $\theta$, and its longitude is $\phi$, and the longitude of a geostationary satellite is $\phi s$ and its longitude difference $\Delta\phi=\phi-\phi s$, the equal longitude difference lines are loci on a hemispherical surface obtained by changing $\theta$ while keeping $\Delta\phi$ constant, and the equal latitude lines are loci on a hemispherical surface obtained by changing $\theta$ while keeping $\Delta\phi$ constant.

18. A radio wave lens antenna device according to claim 12, combined with a pointing map for a radio wave lens antenna device wherein the following equal latitude lines and equal longitude difference lines used as indexes for positioning antenna elements are drawn on the surface of a hemispherical Luneberg lens or on a film stuck on the surface of said lens, assuming that the latitude of the antenna installation point is $\theta$, and its longitude is $\phi$, and the longitude of a geostationary satellite is $\phi s$ and its longitude difference $\Delta\phi=\phi-\phi s$, the equal longitude difference lines are loci on a hemispherical surface obtained by changing $\theta$ while keeping $\Delta\phi$ constant, and the equal latitude lines are loci on a hemispherical surface obtained by changing $\Delta\phi$ while keeping $\theta$ constant.

19. A pointing map for a radio wave lens antenna device having a cover which is put on a hemispherical Luneberg lens, wherein the following equal latitude lines and equal longitude difference lines used as indexes for positioning antenna elements, and a pointing mark showing a reference direction for mounting said cover on said lens are drawn on the surface of said cover, assuming that the latitude of the antenna installation point is $\theta$, and its longitude is $\phi$, and the longitude of a geostationary satellite is $\phi s$ and its longitude difference $\Delta\phi=\phi-\phi s$, the equal longitude difference lines are loci on a hemispherical surface obtained by changing $\theta$ while keeping $\Delta\phi$ constant, and the equal latitude lines are loci on a hemispherical surface obtained by changing $\Delta\phi$ while keeping $\theta$ constant.

20. A pointing map for a radio wave lens antenna device wherein the following equal latitude lines and equal longitude difference lines used as indexes for positioning antenna elements are drawn on the surface of a hemispherical Luneberg lens or on a film stuck on the surface of said lens, assuming that the latitude of the antenna installation point is $\theta$, and its longitude is $\phi$, and the longitude of a geostationary satellite is $\phi s$ and its longitude difference $\Delta\phi=\phi-\phi s$, the equal longitude difference lines are loci on a hemispherical surface obtained by changing $\theta$ while keeping $\Delta\phi$ constant, and the equal latitude lines are loci on a hemispherical surface obtained by changing $\Delta\phi$ while keeping $\theta$ constant.

21. A radio wave lens antenna device comprising a radio wave reflecting plate, a hemispherical Luneberg lens provided on said reflecting plate with the half-cut surface of the sphere along the reflecting surface, an antenna element for transmitting, receiving or transmission and receiving radio waves, and a support for said antenna element, and combined with the pointing map claimed in claim 19 or 20.

22. A radio wave lens antenna device as claimed in claim 21, comprising a radio wave lens antenna device including a radio wave reflecting plate, a hemispherical Luneberg lens provided on said reflecting plate with the half-cut surface of the sphere along the reflecting surface, and an antenna element for transmitting, receiving or transmitting and receiving radio waves, and a pointing map for a radio wave lens antenna device having a hemispherical radome as a cover which is put on a hemispherical Luneberg lens, and an element holder mountable on the surface of said radome, wherein the following equal latitude lines and equal longitude difference lines used as indexes for positioning antenna elements, and a pointing mark showing a reference direction for mounting said cover on said lens are drawn on the surface of said cover, assuming that the latitude of the antenna installation point is $\theta$, and its longitude is $\phi$, the longitude of a geostationary satellite is $\phi s$ and its longitude difference $\Delta\phi=\phi-\phi s$, the equal longitude difference lines are loci on a hemispherical surface obtained by changing $\theta$ while keeping $\Delta\phi$ constant, and the equal latitude lines are loci on a hemispherical surface obtained by changing $\theta$ while keeping $\Delta\phi$constant, said antenna element being mounted on said element holder, whereby the positioning of said antenna element relative to a geostationary satellite is carried out by selecting a mounting point in said element holder.

* * * * *

US007061448C1

(12) EX PARTE REEXAMINATION CERTIFICATE (6667th)

United States Patent

Kuroda et al.

(10) Number: US 7,061,448 C1

(45) Certificate Issued: Feb. 17, 2009

(54) RADIO WAVE LENS ANTENNA APPARATUS

(75) Inventors: Masatoshi Kuroda, Osaka (JP); Tetsuo Kishimito, Osaka (JP); Katsuyuki Imai, Osaka (JP); Yoshizo Shibano, Osaka (JP)

(73) Assignees: Sumitomo Electric Industries, Chuo-Ku, Osaka (JP); JSAT Corporation, Marunouchi, Chiyoda-Ku Tokyo (JP)

Reexamination Request:
No. 90/008,497, Mar. 9, 2007

Reexamination Certificate for:

| | |
|---|---|
| Patent No.: | **7,061,448** |
| Issued: | **Jun. 13, 2006** |
| Appl. No.: | **10/490,942** |
| Filed: | **Aug. 17, 2004** |

(22) PCT Filed: Sep. 9, 2002

(86) PCT No.: PCT/JP02/09179

§ 371 (c)(1), (2), (4) Date: Aug. 17, 2004

(87) PCT Pub. No.: WO03/030303

PCT Pub. Date: Apr. 10, 2003

(51) Int. Cl.
*H01Q 15/08* (2006.01)
*H01Q 19/06* (2006.01)

(52) U.S. Cl. ..... 343/911 L; 343/753; 343/754

(58) Field of Classification Search ..... None
See application file for complete search history.

(56) References Cited

U.S. PATENT DOCUMENTS 3,487,413 A 12/1969 Shores

FOREIGN PATENT DOCUMENTS

| | | |
|---|---|---|
| JP | 09-181523 | 7/1997 |
| JP | 10-163730 | 6/1998 |
| WO | 92/13373 | 8/1992 |
| WO | 93/10572 | 5/1993 |
| WO | 94/19842 | 9/1994 |
| WO | 01/37374 A1 | 5/2001 |

OTHER PUBLICATIONS

Fujimoto, M., "A DBS Antenna–Receiver System for Simultaneous Multi–Satellite Reception", Jun. 1992, p. 184–185.

Fujimoto, M., "A DBS Antenna–Receiver System for Simultaneous Multi–Satellite Reception", IEEE Transactions on Consumer Electronics, vol. 38, No. 3, Aug. 1992, p. 394–396.

Harrison, D.M., "A Hemispherical Lens Antenna for Multi–Satellite Reception", p. 1332–1335.

*Primary Examiner*—Minh T Nguyen

(57) ABSTRACT

A small, lightweight radio wave lens antenna device is proposed in which freedom of selection of the installation place is high, which can be compactly installed e.g. on a wall surface, and in which restriction of installation space is relaxed. A hemispherical Luneberg lens 2 is mounted on a reflecting plate 1, antenna elements 4 are supported by a retainer 3, they are integrally combined, and a mounting portion 5 is provided for mounting the reflecting plate 1 to a installation portion such as a wall surface with the reflecting plate 1 substantially vertical. The reflecting plate 1 may have such a shape that an area other than the area for reflecting radio waves from directions in a predetermined range is removed, preferably in the shape of a fan. The hemispherical Luneberg lens 2 is mounted on the reflecting plate 1, offset toward the small arcuate edge 1b of the fan. Further, a support arm 9 straddling the lens 2 is provided in the antenna device having a hemispherical Luneberg lens 2 provided on the reflecting plate 1, antenna elements 4 are mounted on an arcuate element retaining portion 9a of the support arm 9 along the spherical surface of the lens 2 with an angle adjustor 15 for adjusting the elevation at intervals corresponding to the distances between geostationary satellites by means of mounting means 11. Thereafter, the support arm 9 is pivoted to a predetermined angular position so that the antenna elements can be comprehensively positioned.

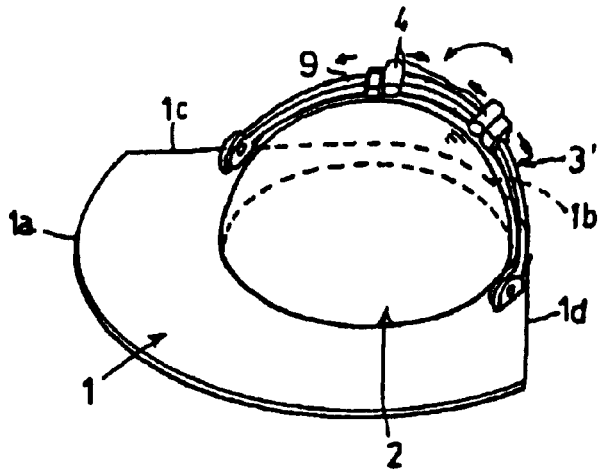

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 4 and 9 are determined to be patentable as amended.

Claim 2, dependent on an amended claim, is determined to be patentable.

Claims 3, 5–8 and 10–22 were not reexamined.

1. [A] *The* radio wave lens antenna device *as claimed in claim 4 further* comprising [a hemispherical Luneberg lens made of a dielectric material, a reflecting plate having a larger size than the diameter of said lens at a half-cut surface of the sphere of said lens, an antenna element provided at the focal point of said lens, a retainer for retaining said antenna element, and] a mounting portion for mounting said antenna device on an installation portion, said reflecting plate being mounted on said installation portion so as to be substantially vertical relative to the ground.

4. A radio wave lens antenna device comprising a hemispherical Luneberg lens made of a dielectric material, a reflecting plate having a larger size than the diameter of said lens at a half-cut surface of the sphere of said lens, [and] an antenna element provided at the focal point portion of said lens, and a retainer for retaining said antenna element, wherein said reflecting plate is formed into a noncircular shape by removing an area other than a portion which reflects radio waves from directions in a predetermined range, and wherein said Luneberg lens is mounted on said reflecting plate offset to a direction opposite to the direction in and from which said lens transmits and receives radio waves.

9. [A] *The* radio wave lens antenna device [comprising a] *as claimed in claim 4 wherein said* reflecting plate *is* for radio waves, [a] *said* hemispherical Luneberg lens *is* provided on said reflecting plate with the half-cut surface of the sphere along the reflecting surface, [an] *said* antenna element *is* for transmitting, receiving or transmitting and receiving radio waves, and [a] *said* retainer *is* for retaining said antenna elements in a predetermined position, said antenna element being plural so as to correspond to a plurality of communicating parties.

* * * * *